US009845673B2

(12) United States Patent
Gisolf et al.

(10) Patent No.: US 9,845,673 B2
(45) Date of Patent: Dec. 19, 2017

(54) SYSTEM AND METHOD FOR CONTROLLED PUMPING IN A DOWNHOLE SAMPLING TOOL

(71) Applicant: Schlumberger Technology Corporation, Sugar Land, TX (US)

(72) Inventors: Adriaan Gisolf, Houston, TX (US); Nathan Landsiedel, Fresno, TX (US); Cosan Ayan, Istanbul (TR); Kenneth Moelhoff, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 506 days.

(21) Appl. No.: 14/301,963

(22) Filed: Jun. 11, 2014

(65) Prior Publication Data

US 2015/0361791 A1 Dec. 17, 2015

(51) Int. Cl.
*E21B 49/00* (2006.01)
*E21B 49/08* (2006.01)

(52) U.S. Cl.
CPC ..... *E21B 49/008* (2013.01); *E21B 49/00* (2013.01); *E21B 49/08* (2013.01)

(58) Field of Classification Search
CPC ..... E21B 49/00; E21B 49/008; E21B 49/08; E21B 49/10; E21B 49/087; E21B 49/088; E21B 49/084; E21B 47/00; E21B 44/005
See application file for complete search history.

(56) References Cited

U.S. PATENT DOCUMENTS

| | | | |
|---|---|---|---|
| 5,934,374 | A | 8/1999 | Hrametz et al. |
| 6,092,416 | A | 7/2000 | Halford et al. |
| 6,347,666 | B1 | 2/2002 | Langseth |
| 6,352,110 | B1 | 3/2002 | Langseth et al. |
| 6,357,525 | B1 | 3/2002 | Langseth et al. |
| 6,382,315 | B1 | 5/2002 | Langseth |
| 6,439,306 | B1 | 8/2002 | Patel |
| 6,467,544 | B1 | 10/2002 | Brown et al. |
| 6,659,177 | B2 | 12/2003 | Bolze et al. |
| 6,688,390 | B2 | 2/2004 | Bolze et al. |

(Continued)

OTHER PUBLICATIONS

Raghuraman et al. "Real-Time Downhole pH Measurement Using Optical Spectroscopy," SPE 93057, 2005 SPE International Symposium on Oilfield Chemistry held in Houston, Texas, U.S.A., Feb. 2-4, 2005, pp. 1-11.

*Primary Examiner* — Yong-Suk (Philip) Ro
(74) *Attorney, Agent, or Firm* — Michael Dae

(57) ABSTRACT

A downhole tool designed to be disposed in a borehole of a subterranean formation is provided. The downhole tool includes a probe used to interface with the subterranean formation in order to sample fluid from or to inject fluid into the subterranean formation. The downhole tool also includes a sample flowline fluidly coupled to the probe and used to direct fluid through the downhole tool. The downhole tool further includes at least two volume chambers. These volume chambers each include a first side fluidly coupled to the sample flowline, a second side fluidly coupled to the guard flowline, and a piston separating the first side from the second side. The downhole tool is able to control a flow of fluid from a high pressure environment to a low pressure environment via the at least two volume chambers, the sample flowline, and the guard flowline.

8 Claims, 14 Drawing Sheets

(56) References Cited

U.S. PATENT DOCUMENTS

| | | | | |
|---|---|---|---|---|
| 7,083,009 | B2 | 8/2006 | Paluch et al. | |
| 7,090,012 | B2 | 8/2006 | Hill et al. | |
| 7,140,436 | B2 | 11/2006 | Grant et al. | |
| 7,158,887 | B2 | 1/2007 | Betancourt et al. | |
| 7,195,063 | B2 | 3/2007 | Nogueira et al. | |
| 7,243,536 | B2 | 7/2007 | Bolze et al. | |
| 7,293,715 | B2 | 11/2007 | Bargach et al. | |
| 7,379,819 | B2 | 5/2008 | Betancourt et al. | |
| 7,546,885 | B2 | 6/2009 | Longfield | |
| 7,596,995 | B2 | 10/2009 | Irani et al. | |
| 7,621,325 | B2 | 11/2009 | Shammai et al. | |
| 8,397,817 | B2 | 3/2013 | Edwards | |
| 2010/0157737 | A1 | 6/2010 | Miller et al. | |
| 2012/0227963 | A1* | 9/2012 | Dumlupinar | E21B 49/10 166/264 |
| 2014/0131037 | A1 | 5/2014 | Hsu et al. | |
| 2016/0215617 | A1* | 7/2016 | Samec | E21B 49/10 |

* cited by examiner

SYSTEM AND METHOD FOR CONTROLLED PUMPING IN A DOWNHOLE SAMPLING TOOL

BACKGROUND

The present disclosure relates generally to downhole tools and more particularly to tools for sampling and analyzing formation fluid.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Wells are generally drilled into a surface (land-based) location or ocean bed to recover natural deposits of oil and gas, as well as other natural resources that are trapped in geological formations in the Earth's crust. A well is often drilled using a drill bit attached to the lower end of a "drill string," which includes drillpipe, a bottom hole assembly, and other components that facilitate turning the drill bit to create a borehole. Drilling fluid, or "mud," is pumped down through the drill string to the drill bit during a drilling operation. The drilling fluid lubricates and cools the drill bit, and it carries drill cuttings back to the surface in an annulus between the drill string and the borehole wall.

Information about the subsurface formations, such as measurements of the formation pressure, formation permeability and the recovery of formation fluid samples may be useful for predicting the economic value, the production capacity, and production lifetime of a subsurface formation. Formation fluid samples may be extracted from the well and evaluated in a laboratory to establish physical and chemical properties of the formation fluid. Such evaluation may include analyses of fluid viscosity, density, composition, gas/oil ratio (GOR), differential vaporization, PVT analysis, multi-stage separation tests, and so forth. Recovery of formation fluid samples, in order to perform such evaluations, may be accomplished using different types of downhole tools, which may be referred to as formation testers.

Formation testing tools may use pumps to withdraw fluid from a formation for analysis within the tool or storing the fluid in a sample chamber for later analysis. Formation testing tools generally utilize reciprocating piston pumps fitted with mud check valves to pump downhole fluids through the tool. The pumps are able to pump downhole fluids from a low pressure to a higher pressure, but may not be able to pump downhole fluids from a high pressure to a lower pressure.

SUMMARY

In a first embodiment, a downhole tool is designed to be disposed in a borehole of a subterranean formation. The downhole tool includes a probe used to interface with the subterranean formation in order to sample fluid from or to inject fluid into the subterranean formation. The downhole tool also includes a sample flowline fluidly coupled to the probe and used to direct fluid through the downhole tool. The downhole tool further includes at least two volume chambers. These volume chambers each include a first side fluidly coupled to the sample flowline, a second side fluidly coupled to the guard flowline, and a piston separating the first side from the second side. The downhole tool is able to control a flow of fluid from a high pressure environment to a low pressure environment via the at least two volume chambers, the sample flowline, and the guard flowline.

In another embodiment, a drilling system includes a volume chamber module designed to be coupled to other modules in a tool string of the drilling system. The volume chamber module includes a bulk volume chamber, a sample flowline, and a guard flowline. The bulk volume chamber includes a first side fluidly coupled to the sample flowline, a second side fluidly coupled to the guard flowline, and a piston separating the first side from the second side. The volume chamber module is used to facilitate controlled pumping of a fluid from a first environment of the tool string to a second environment of the tool string, wherein the first environment is at a higher pressure than the second environment.

In a further embodiment, a method includes engaging a subterranean formation via a probe of a downhole tool disposed in a borehole of the subterranean formation. The downhole tool includes a sample flowline, a guard flowline, and a first volume chamber. The first volume chamber includes a first side fluidly coupled to the sample flowline, a second side fluidly coupled to the guard flowline, and a piston separating the first side from the second side. The method also includes controlling a first fluid flow from the first volume chamber into and through the guard flowline. The first fluid flow enters the guard flowline at a first pressure. Further, the method includes controlling a second fluid flow through the sample flowline based on the first fluid flow through the guard flowline. Controlling the second fluid flow involves moving the second fluid flow from an environment with a second pressure to an environment with a third pressure, wherein the second pressure is higher than the third pressure.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
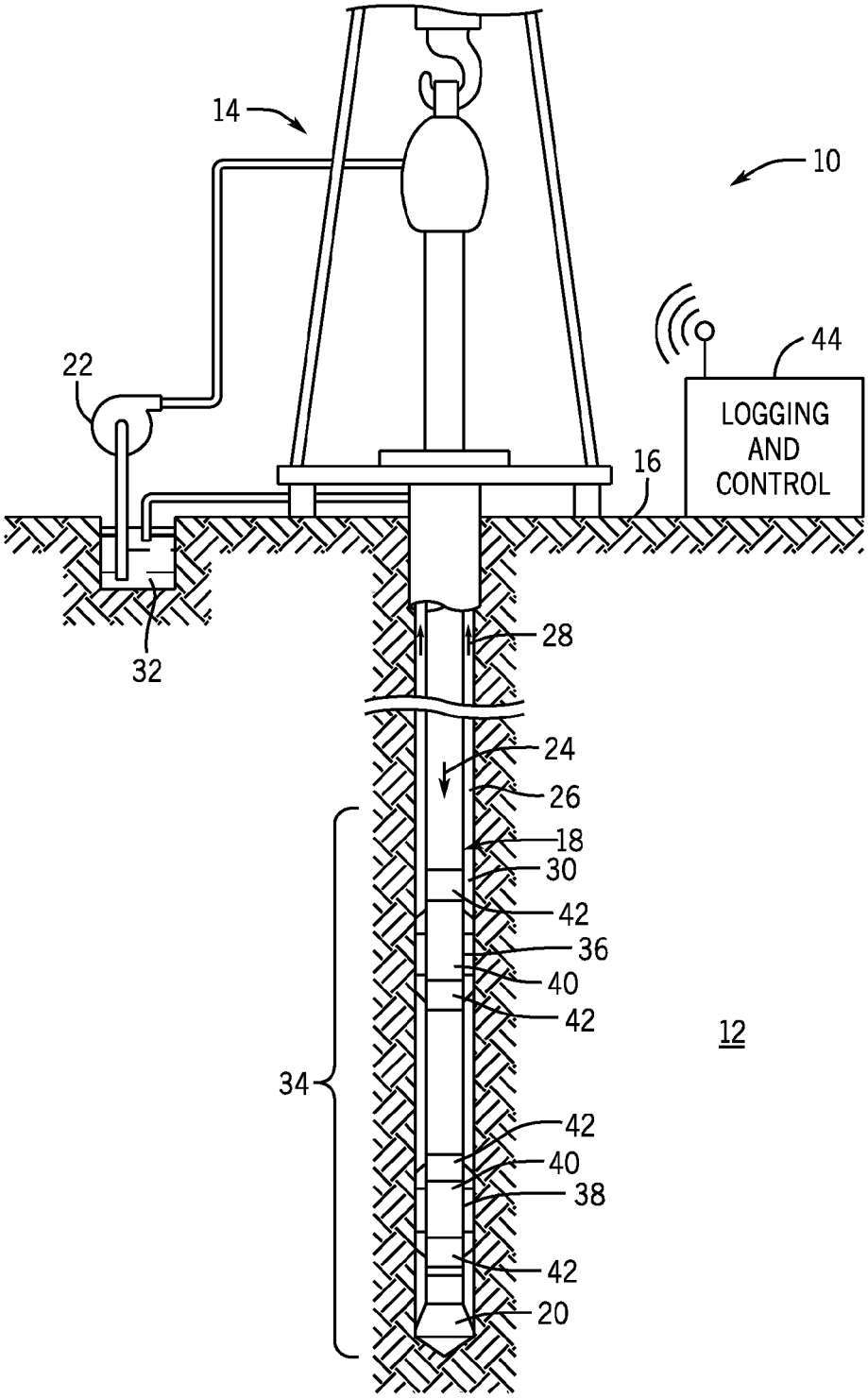
FIG. 1 is a partial cross sectional view of a drilling system used to drill a well through subsurface formations, in accordance with an embodiment of the present techniques.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Present embodiments are directed to systems and methods for providing controlled pumping of fluid through a downhole formation fluid sampling tool. More specifically, present embodiments are directed to systems and methods that allow for controlled pumping of fluids, such as sampled formation fluids, across a positive or negative pressure difference. Existing downhole sampling tools typically include reciprocating piston pumps fitted with mud check valves to pump downhole fluids, such as formation fluids, through the downhole sampling tool. This type of pump and mud check valve system is designed to pump fluid from a low pressure input side to a high pressure output side. Thus, wells are typically drilled with an overbalance. This means that fluid is pumped from the formation (at a relatively lower pressure) into the borehole (at a relatively higher pressure) in a controlled manner.

In some circumstances, pumping downhole fluid from the borehole into the formation may be desirable, such as in micro-frac operations where fluid is injected into the formation to fracture the formation. In some instances, the pressure used to push fluid into the formation in such operations may be higher than the overbalance of the downhole tool, thus allowing the downhole tool to move the fluid from a lower pressure in the borehole to a higher pressure in the formation.

However, in other circumstances, the pump intake side may be at a higher pressure than the pump output side. When using existing downhole tools with reciprocating piston pumps and mud check valves, this type of pressure difference would enable fluid to move freely through the mud check valves. This makes the controlled pumping of formation fluid from a high pressure to a low pressure difficult or impossible using a reciprocating piston pump and mud check valve system.

Certain downhole operations may be desirable that involve moving formation fluid from a high pressure environment to a low pressure environment. For example, it may be desirable to inject fluids into the formation when the pressure to inject the fluids is less than the overbalance pressure of the downhole tool. That is, it may be desirable to move fluid from a high pressure (e.g., borehole) to a lower pressure (e.g., formation) in a controlled manner. In addition, during formation fracturing operations (e.g., micro-frac operations), it may be desirable to measure the pressure decline within the formation. However, if the injected fluid does not leak into the formation, the pressure may not decline at a sufficient rate to be measurable. In such instances it is desirable to provide a slow, controlled flowback of the formation fluid from a relatively high pressure into the downhole tool at a lower pressure.

As noted above, existing reciprocating piston pump and mud check valve systems are not capable of providing controlled flow of fluids from a high pressure environment to a lower pressure environment. While some flow control modules exist for moving downhole fluids from a high pressure environment to a lower pressure environment, these modules are generally used for high pressure drawdowns and are configured to pump relatively small volumes of fluid through a downhole tool. For example, these flow control modules generally have size limitations of approximately one liter, which is too small for some applications that might benefit from controlled high pressure to lower pressure pumping. Specifically, micro-frac operations may not be performed with a pump configured to handle such a small volume of liquid. Accordingly, it is now recognized that improved systems for pumping downhole fluids from a high pressure environment to a low pressure environment are desired.

Presently disclosed embodiments are directed to systems and methods for providing controlled pumping of fluid through a downhole formation fluid sampling tool from a high pressure environment to a lower pressure environment. To that end, presently disclosed downhole sampling tools may include multiple volume chambers that may be controlled to store fluids at desired pressures. These volume chambers each include two sides separated by a piston, and the volume chambers may be configured to handle relatively high volumes of fluids within the two sides. A downhole sampling tool includes multiple such volume chambers disposed along its length, and the sides of these volume chambers may be in fluid communication with one of two flowlines extending through the downhole tool. The downhole tool may control pumping of formation fluids and other fluids through the two flowlines, the volume chambers, a probe of the downhole tool, exit ports of the downhole tool, a reciprocating pump, and other components in order to create an artificial pressure environment in one of the two flowlines. Then, the formation fluid, or some other fluid, may be pumped in a controlled manner against the artificial pressure environment. This allows the downhole tool to pump larger volumes of fluids and a larger variety of fluids from a high pressure environment to a low pressure environment than would be possible using existing systems and methods.

FIG. 1 illustrates a drilling system 10 used to drill a well through subsurface formations 12. A drilling rig 14 at the surface 16 is used to rotate a drill string 18 that includes a drill bit 20 at its lower end. As the drill bit 20 is rotated, a "mud" pump 22 is used to pump drilling fluid, commonly referred to as "mud" or "drilling mud," downward through the center of the drill string 18 in the direction of the arrow 24 to the drill bit 20. The mud, which is used to cool and lubricate the drill bit 20, exits the drill string 18 through ports (not shown) in the drill bit 20. The mud then carries drill cuttings away from the bottom of a borehole 26 as it flows back to the surface 16, as shown by the arrows 28 through an annulus 30 between the drill string 18 and the formation 12. At the surface 16, the return mud is filtered and conveyed back to a mud pit 32 for reuse.

While a drill string 18 is illustrated in FIG. 1, it will be understood that the embodiments described herein are applicable to work strings and wireline tools as well. Work strings may include a length of tubing (e.g. coil tubing) lowered into the well for conveying well treatments or well servicing equipment. Wireline tools may include formation testing tools suspended from a multi-wire cable as the cable is lowered into a well so that it can measure formation properties at desired depths. It should be noted that the location and environment of the well may vary widely depending on the formation 12 into which it is drilled. Instead of being a surface operation, for example, the well may be formed under water of varying depths, such as on an ocean bottom surface. Certain components of the drilling system 10 may be specially adapted for underwater wells in such instances.

As illustrated in FIG. 1, the lower end of the drill string 18 includes a bottom-hole assembly ("BHA") 34 that includes the drill bit 20, as well as a plurality of drill collars 36, 38. The drill collars 36, 38 may include various instruments, such as sample-while-drilling ("SWD") tools that include sensors, telemetry equipment, and so forth. For example, the drill collars 36, 38 may include logging-while-drilling ("LWD") modules 40 and/or measurement—while drilling ("MWD") modules 42. The LWD modules or tools 40 may include tools configured to measure formation parameters or properties, such as resistivity, porosity, permeability, sonic velocity, and so forth. The MWD modules or tools 42 may include tools configured to measure borehole trajectory, borehole temperature, borehole pressure, and so forth. The LWD modules 40 of FIG. 1 are each housed in one of the drill collars 36, 38, and each contain any number of logging tools and/or fluid sampling devices. The LWD modules 40 include capabilities for measuring, processing and/or storing information, as well as for communicating with the MWD modules 42 and/or directly with the surface equipment such as, for example, a logging and control computer 44.

Present embodiments are directed toward systems and methods that allow downhole equipment, such as the LWD modules 40, to pump formation fluid and other fluids from a high pressure environment (e.g., borehole 26) to a lower pressure environment (e.g., formation 12). This may enable the LWD modules 40 to perform operations that would otherwise not be possible. Such operations may include, for example, sampling from and re-injecting formation fluids into the formation 12, sampling formation fluids and injecting chemicals into the formation 12, injecting tracers into the formation 12, providing enhanced oil recovery analysis, and providing flowback control. The disclosed downhole equipment may also be useful in micro-fracture (micro-frac) operations, where fluids are injected into the formation 12 to break open a portion of the formation 12.

Figure 2:
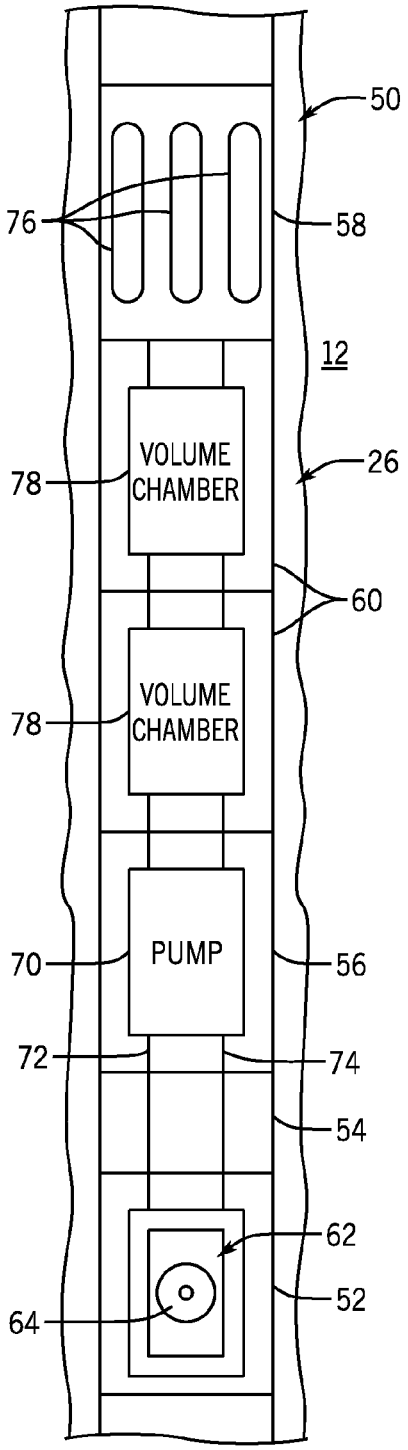
FIG. 2 is a schematic diagram of downhole equipment having pump modules used to sample fluid from subsurface formations, in accordance with an embodiment of the present techniques.

Having now discussed the functions that may be performed through the use of presently disclosed downhole equipment, a more detailed discussion of the structure of such downhole equipment is provided. To that end, FIG. 2 is a schematic diagram of an embodiment of downhole equipment (equipment configured for operation downhole) used to sample a well formation, to inject fluid into a well formation, or both. Specifically, the illustrated downhole equipment includes an embodiment of a downhole fluid formation sampling tool 50, hereinafter referred to as a downhole tool 50.

The downhole tool 50 is illustrated as being disposed within the borehole 26 of the subsurface formation 12 in order to sample formation fluid from the formation 12, to inject fluid into the formation 12, or both. In some embodiments, the downhole tool 50 is disposed in the borehole 26 via a wireline. That is, the downhole tool 50 may be suspended in the borehole 26 from a lower end of the wireline, which may be a multi-conductor cable spooled from a winch. The wireline may be electrically coupled to surface equipment, in order to communicate various control signals and logging information between the downhole tool 50 and the surface equipment. It should be noted that in other embodiments, such as shown in FIG. 1, the downhole tool 50 may include one or more of the SWD tools (e.g., LWD modules 40), which are disposed in the borehole 26 via the drill string 18. In still other embodiments, the downhole tool 50 may include drill stem testing tools, which are testing tools that form the BHA 34 (without a drill bit 20) of a string of tubular lowered from the drilling rig 14 into the borehole 26.

The illustrated downhole tool 50 includes a probe module 52, a hydraulics module 54 a pump module 56, a multi-sample module 58, and two volume chamber modules 60. It should be noted that other arrangements of the modules that make up the downhole tool 50 may be possible. For example, in some embodiments, there may be several multi-sample modules 58, or certain components of the pump module 56 and the hydraulics module 54 may be combined. Moreover, the components shown within each of the illustrated modules may be arranged differently in other embodiments of the downhole tool 50. In addition, these components of the downhole tool 50 may be arranged differently depending on the type of fluid sampling, injection, or flowback control applications to be carried out by the downhole tool 50. For example, FIGS. 7, 9, 11, 14, and 16 illustrate specific arrangements that may be desirable for downhole tools 50 designed to perform different operations within the borehole 26.

The illustrated probe module 52 includes an extendable fluid communication line (probe 62) designed to engage the formation 12 and to communicate formation fluid from the formation 12 into the downhole tool 50. In the illustrated embodiment, the probe 62 includes a rubber "donut" configured to extend from the probe module 52 and to engage the wall of the borehole 26. In the illustrated embodiment, this donut defines a fluid inlet 64 into the probe 62, and the formation fluid is pumped into the downhole tool 50 through this fluid inlet 64. Thus, the probe 62 functions as an inlet for the formation fluid pumped into the downhole tool 50, as well as an outlet for fluids being injected into the formation 12.

In addition to the probe 62, the probe module 52 may include two or more setting mechanisms (not shown). Setting mechanisms are configured to extend outward from the probe module 52 and to engage the borehole 26 in an opposite direction from the extendable probe 62. The setting mechanisms may include pistons in some embodiments, although other types of probe modules 52 may utilize a different type of probe 62 and/or setting mechanism.

In some embodiments, the probe module 52 may utilize a different type of probe 62 than the one illustrated in FIG. 2. For example, the probe module 52 may include one or more packer elements configured to be inflated into contact with an inner wall of the borehole 26. In this manner, the packer elements may function as setting mechanisms for keeping the downhole tool 50 in place and for isolating a section of the borehole 26 around the probe 62. It should be noted that the presently disclosed techniques of pumping fluid from a high pressure to a lower pressure while downhole may utilize any number of probes 62 and/or packers. Additionally, the arrangement, configuration, size, or shape of these probes 62 and/or packers may vary across different embodiments.

The hydraulics module 54 may include, among other things, electronics, batteries, sensors, and/or hydraulic components used to operate the probe 62 and any corresponding setting mechanisms within the probe module 52. The pump module 56 may include a pump 70 used to create a pressure differential that draws the formation fluid in through the probe 62 and pushes the fluid through one of two flowlines 72 and 74 of the downhole tool 50. The pump 70 may include an electromechanical pump used for pumping formation fluid from the probe module 52 to the multi-sample modules 58 and/or out of the downhole tool 50. In an embodiment, the pump 70 operates as a piston displacement unit (DU) driven by a ball screw coupled to a gearbox and an electric motor, although other types of pumps 70 may be used in other embodiments. Power may be supplied to the pump 70 via other components located in the pump module 56, via components located in the hydraulics module 54, or via a separate power generation module (not shown). During a sampling process, the pump 70 moves the formation fluid through one of the flowlines (e.g., 72), toward the one or more multi-sample modules 58 or the volume chamber modules 60.

The multi-sample modules 58 each include one or more sample bottles 76 for collecting samples of the formation fluid being pumped through the downhole tool 50. Based on characteristics of the formation fluid detected via sensors (e.g., spectrometer, pressure sensors, temperature sensors, etc.) along one or both of the flowlines 72 and 74, the downhole tool 50 may be operated in a sample collection mode or a continuous pumping mode. When operated in the sample collection mode, valves disposed at or near entrances of the sample bottles 76 may be positioned to allow the formation fluid to flow into the sample bottles 76. The sample bottles 76 may be filled one at a time, and once a sample bottle 76 is filled, its corresponding valve may be moved to another position to seal the sample bottle 76. When the valves are closed, the downhole tool 50 may operate in a continuous pumping mode.

In a continuous pumping mode, the pump 70 moves the formation fluid into the downhole tool 50 through the probe 62, through one or both of the flowlines 72 and 74, and out of the downhole tool 50 through a flowline exit port (not shown). The flowline exit port may be a check valve that releases the formation fluid into the borehole 26, or it may be a valve which performs a similar function but is operated by commands sent from equipment at the surface. The downhole tool 50 may operate in the continuous pumping mode until the formation fluid flowing through the flowline 72 is determined to be clean enough for sampling. This is because when the formation fluid is first sampled, residual drilling mud filtrate may enter the downhole tool 50 along with the sampled formation fluid. After pumping the formation fluid for an amount of time, the formation fluid flowing through the downhole tool 50 may provide a more pure sample of the uncontaminated formation fluid than would otherwise be available when first drawing fluid in through the probe 62.

In addition to the modules described above, present embodiments of the downhole tool 50 include one or more volume chamber modules 60. These volume chamber modules 60 each include a bulk volume chamber 78 configured to receive, store, and release relatively large volumes of fluids. There are two sides of each volume chamber 78 that can hold separate types of fluid, and each side may be configured to receive fluid from or transmit fluid to the first flowline 72, the second flowline 74, a port leading to the borehole 26, or some combination thereof. This makes the volume chamber 78 relatively versatile for use in directing fluid flow through the two flowlines 72 and 74 in the downhole tool 50.

As discussed in detail below, the downhole tool 50 may be arranged such that the pump 70 pumps fluids into and out of the different sides of the volume chambers 78, in order to generate a depressurized environment or a pressurized environment in one of the flowlines 72 and 74. This enables the pump 70 to then pump formation fluid, or some other fluid, through the downhole tool 50 across a desirable pressure differential. As a result, the downhole tool 50 may be able to pump relatively large volumes of fluid from a high pressure environment to a low pressure environment, in addition to performing other operations.

Embodiments of the presently disclosed downhole tool 50 may include volume chamber modules 60 with varying arrangements of volume chambers 78 and flowline connections. FIGS. 3-6 illustrate some examples of different configurations of these volume chamber modules 60. Different types of volume chamber modules 60 such as these may be coupled with other modules (e.g., probe module 52, pump module 56, and multi-sample module 58) to form a downhole tool 50 equipped to perform formation fluid sampling, injection, enhanced oil recovery, micro-frac flowback measurements, and other controlled pumping operations.

As illustrated in FIGS. 3-6, the volume chamber module 60 includes the bulk volume chamber 78, which is a sampling device that contains a piston 90 to separate a top side 92 of the volume chamber 78 from a bottom side 94 of the volume chamber. Throughout the following discussion the top side 92 will be referred to as a "sample side 92", and the bottom side 94 will be referred to as a "water side 94". The flowlines 72 and 74 running through the downhole tool will be referred to as a "sample flowline 72" and a "guard flowline 74".

The volume chamber modules 60 are configured such that fluid can flow into and out of the sample side 92 and water side 94 of the volume chamber 78 from either the sample flowline 72 or the guard flowline 74, or from the borehole 26. The volume chamber modules 60 may be configurable either at the surface or downhole. The flow of fluid between the flowlines 72 and 74 and the volume chamber 78 may be controlled through a seal valve 96, a check valve, a flow restrictor 98 (constant flow rate or variable flow rate), a relief valve 100, or some combination thereof. These valves may be combined with one another in series or in parallel to provide the desired flow characteristics. In some embodiments, the valves may include a motor seal valve capable of throttling the flow of fluid between components, or any other device that may control or restrict the flow of fluid therethrough. In the present context, the term "fluid" is generally defined as hydraulic fluid, water, glycol, formation fluid, chemicals, tracers, or any other control fluid that may be pumped through the downhole tool 50.

Figure 3:
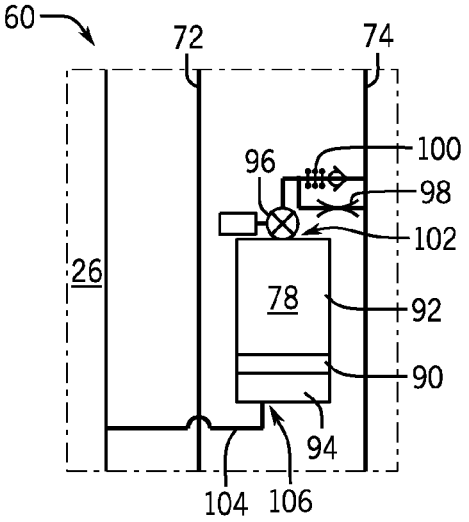
FIG. 3 is a schematic diagram of a bulk volume chamber, in accordance with an embodiment of the present techniques.

Having described the general structure of the disclosed volume chamber modules 60, examples of different variations in the structure will be provided. First, FIG. 3 illustrates a volume chamber module 60 that includes a volume chamber 78 fitted with a seal valve 96, a flow restrictor 98, and a relief valve 100, each disposed between an inlet 102 of the sample side 92 and the guard flowline 74. The volume chamber module 60 features an open connection 104 between an inlet 106 of the water side 94 and the borehole 26.

Figure 4:
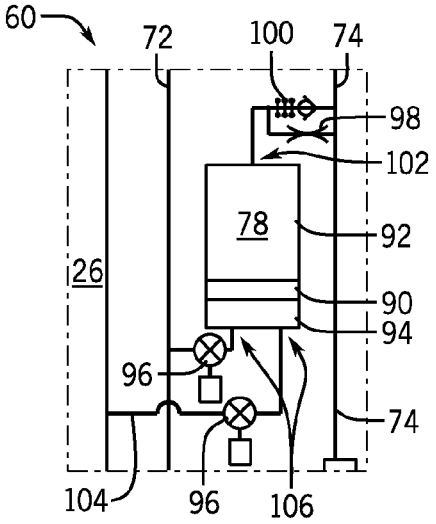
FIG. 4 is a schematic diagram of a bulk volume chamber, in accordance with an embodiment of the present techniques.

FIG. 4 is a schematic view of another example of the volume chamber module 60 that may be employed within the disclosed downhole tool 50. The volume chamber module 60 includes the volume chamber 78, fitted with one flow restrictor 98 and one relief valve 100 disposed between the inlet 102 of the sample side 92 and the guard flowline 74. The volume chamber module 60 also includes one seal valve 96 disposed between the inlet 106 of the water side 94 and the sample flowline 72. Still further, the illustrated volume chamber module 60 of FIG. 4 includes one seal valve 96 between the inlet 106 of the water side 94 and the borehole 26.

Figure 5:
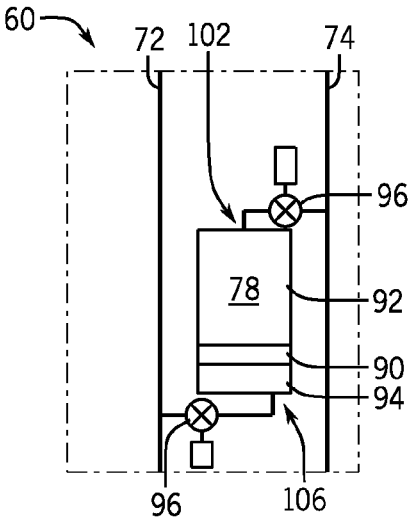
FIG. 5 is a schematic diagram of a bulk volume chamber, in accordance with an embodiment of the present techniques.

In another embodiment shown in FIG. 5, the volume chamber module 60 may include the volume chamber 78, fitted with one seal valve 96 disposed between the inlet 102 of the sample side 92 and the guard flowline 74. Additionally, the illustrated volume chamber module 60 includes another seal valve 96, this one disposed between the inlet 106 of the water side 94 and the sample flowline 72.

Figure 6:
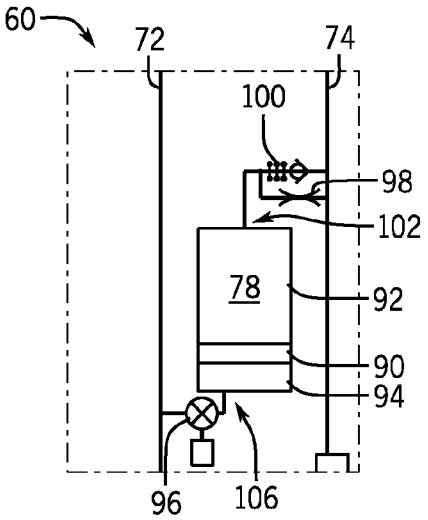
FIG. 6 is a schematic diagram of a bulk volume chamber in accordance with an embodiment of the present techniques.

FIG. 6 provides yet another example of the arrangements that may be used to form fluid connections within the volume chamber module 60. Specifically, the volume chamber module 60 of FIG. 6 includes the volume chamber 78, fitted with one flow restrictor 98 and one relief valve 100 disposed between the inlet 102 of the sample side 92 of the volume chamber 78 and the guard flowline 74. In addition, the illustrated volume chamber module 60 includes one seal valve 96 disposed between the inlet 106 of the water side 94 and the sample flowline 72.

As illustrated in FIGS. 3, 4, and 6, in some embodiments, the flow restrictor 98 and the relief valve 100 may be disposed in a parallel arrangement in order to provide efficient and adequate flow control for a wide range of fluids. The flow restrictor 98 may include one or more layers of orifice plates for restricting the flow of fluid therethrough to a desired constant flow rate or pressure. Since this type of valve uses orifice structures to limit the flow therethrough, the flow restrictor 98 may be unsuitable for transferring a flow of fluid that contains particulate or contaminants, or for allowing fluid to flow quickly into or out of the volume chamber 78. In some embodiments, the flow restrictor 98 may be combined with a check valve to allow fluid to flow out of the volume chamber 78 slowly through the flow restrictor 98, and to back into the volume chamber 78 quickly through the check valve.

Sampling and Re-Injecting Formation Fluids Using a Downhole Tool

As mentioned above, the volume chamber modules 60 may be combined in different combinations and arrangements with the other components that make up the downhole tool 50, in order to provide a desired functionality of the downhole tool 50. One such functionality involves the use of the downhole tool 50 to inject fluid into the formation 12. The pressure within the formation 12 is often lower than the pressure within the downhole tool 50. Thus, in order to effectively pump the fluid into the formation 12 using the reciprocating pump 70, it may be desirable to create a pressure at the inlet side of the pump 70 that is lower than or equal to the pressure of the formation 12. This ensures that fluid is pumped from a lower pressure side of the pump 70 to a higher pressure formation side of the pump 70 and into the formation 12. However, in many instances, it is not desirable to expose the fluid that is being injected to large pressure fluctuations, since this fluid could potentially be sampled formation fluid and, thus, may have a saturation pressure close to the pressure in the formation 12.

Figure 7:
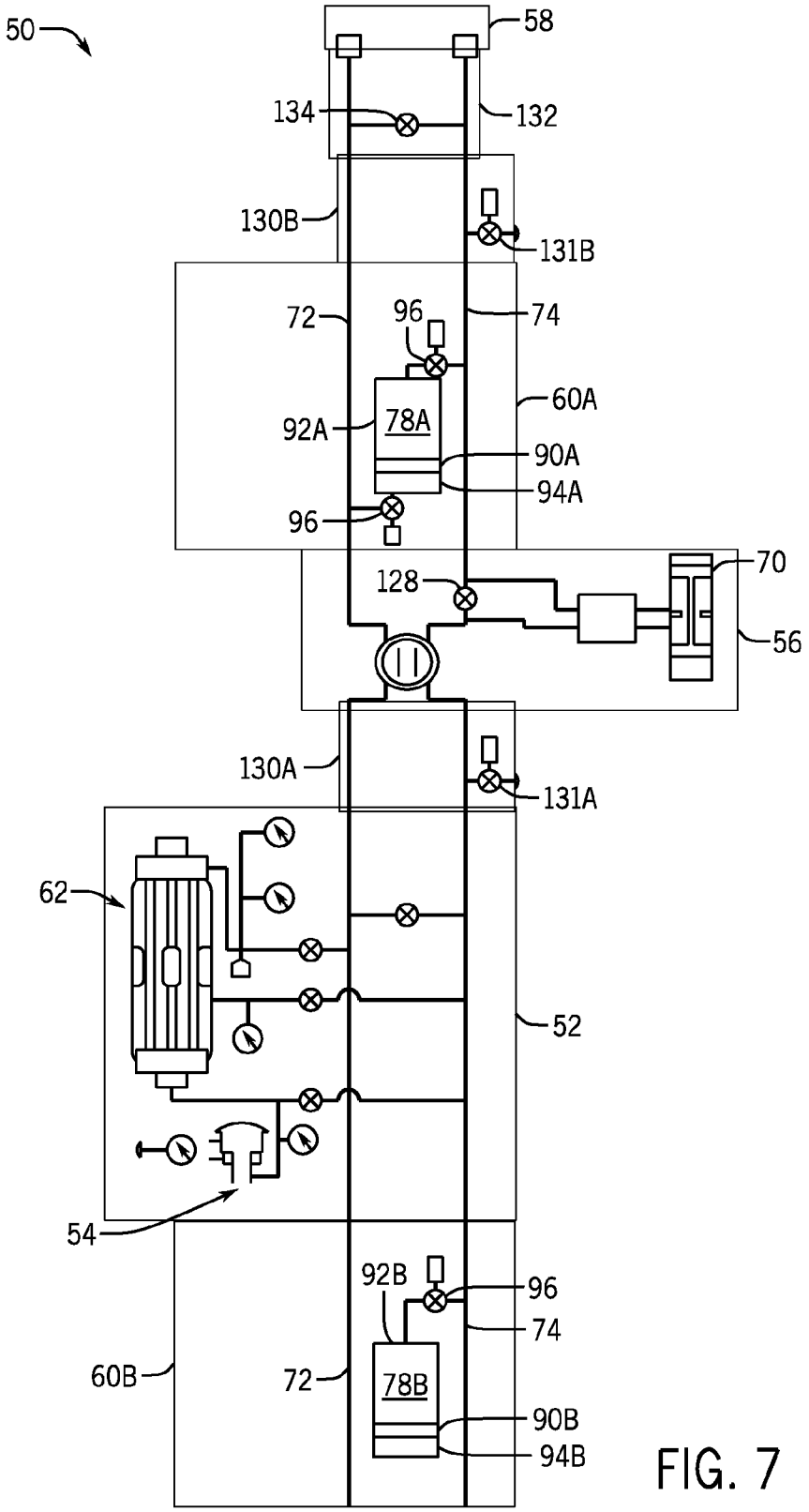
FIG. 7 is a schematic diagram of a downhole tool having bulk volume chambers for sampling and re-injecting formation fluids, in accordance with an embodiment of the present techniques.

FIG. 7 illustrates an embodiment of the downhole tool 50 that uses the volume chamber modules 60 to perform downhole formation fluid sampling and subsequent re-injection of the formation fluid back into the formation 12. In the illustrated embodiment, the downhole tool 50 includes the probe module 52, the pump module 56, two volume chamber modules 60A and 60B, and a multi-sample module 58. As described in detail above, the probe module 52 features the probe 62, which in the illustrated embodiment is a packer probe element, in addition to valves and electronics (e.g., components of the hydraulics module 54) for actuating the probe 62 toward the wall of the borehole 26. In the illustrated pump module 56, the pump 70 is coupled to the guard flowline 74. Thus, the pump module 56 is configured such that the pump 70 can urge the formation fluid through the guard flowline 74. The pump module 56 also includes a pump bypass valve 128 that can be opened when the pump 70 is not being used to pump fluid through the guard flowline 74.

In addition to the components and modules listed above, the downhole tool 50 includes two exit-to-borehole modules 130A and 130B. One exit-to-borehole module 130A is disposed between the probe module 52 and the pump module 56, and the other exit-to-borehole module 130B is disposed between the upper volume chamber module 60A and the multi-sample module 58. The exit-to-borehole modules 130A and 130B each include an exit port valve 131, which may be any controllable seal valve between the guard flowline 74 and the borehole 26. Further, the downhole tool 50 includes a sampling interface module 132 that functions as an interface between the two flowlines 72 and 74 and the multi-sample module 58. The sample interface module 132 includes a seal valve 134 along a line 136 connecting the sample flowline 72 and the guard flowline 74. This seal valve 134 may be actuated to selectively allow fluid to flow between the two flowlines 72 and 74.

In the upper volume chamber module 60A, the volume chamber 78A is coupled between the flowlines 72 and 74 as described above with reference to FIG. 5. More specifically, the sample side 92A of the volume chamber 78A is coupled to the guard flowline 74A via the seal valve 96, while the water side 94A is coupled to the sample flowline 72A via another seal valve 96. In the lower volume chamber module 60B, the volume chamber 78B is coupled to the guard flowline 74, but not to the sample flowline 72. Specifically, the sample side 92B of the volume chamber 78B is coupled to the guard flowline 74 via the seal valve 96.

The configuration of the downhole tool 50 illustrated in FIG. 7 allows for the sampling and re-injection of formation fluid relative to the formation 12. Specifically, formation fluid is sampled into the upper volume chamber 78A. The lower volume chamber 78B will have been filled with air at ambient pressure (or slightly above ambient pressure) at the water side 94B when the downhole tool 50 is at the surface. While running the downhole tool 50 into the borehole 26, the water side 94B may be closed while the sample side 92B is left open to the borehole 26 (e.g., via exit port valve 131). This allows the sample side 92B to fill with borehole fluid, thereby compressing the air cushion in the water side 94B of the lower volume chamber 78B. When the fluid sampled from the formation 12 into the upper volume chamber 78A is to be injected back into formation 12, the pump 70 may pull the borehole fluid from the sample side 92B of the lower volume chamber 78B and push the flowing borehole fluid into the water side 94A of the upper chamber 78A. This borehole fluid may push the formation fluid through the sample side 92A of the upper chamber 78A and into the sample flowline 72 and the formation 12 at a controlled rate. Because the lower volume chamber 78B is air-cushioned, the pressure in this volume chamber 78B may rapidly drop below a pressure of the formation, thereby allowing the pump 70 to move fluid from a low pressure to a high pressure in a controlled fashion. A more detailed description of this process is described below in reference to FIG. 8.

Figure 8:
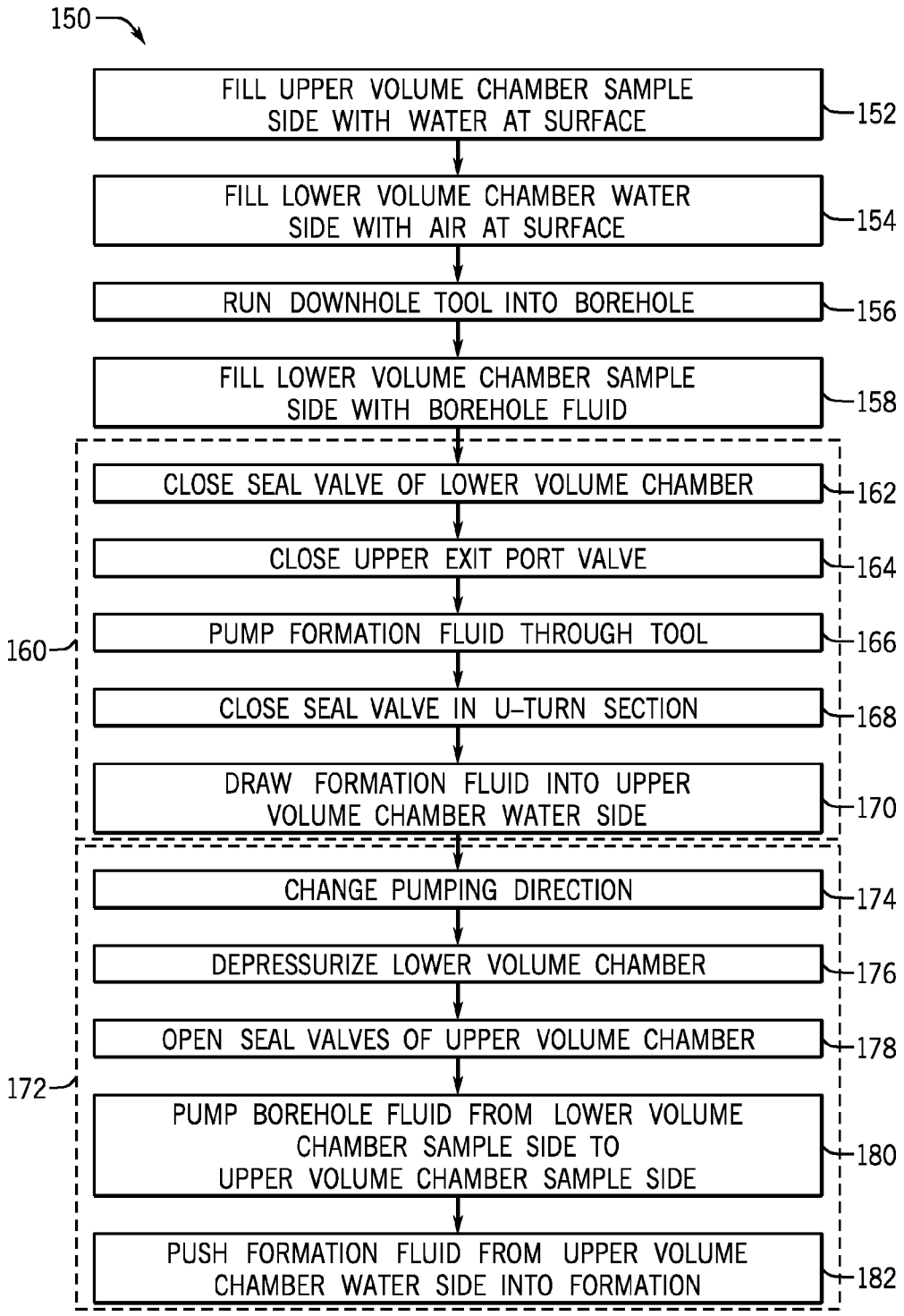
FIG. 8 is a process flow diagram of a method for operating the downhole tool of FIG. 7 to sample and re-inject formation fluid, in accordance with an embodiment of the present techniques.

FIG. 8 is a process flow diagram of a method 150 for performing this set of operations using the downhole tool 50 illustrated in FIG. 7. The method 150 includes filling (block 152) the sample side 92A of the upper volume chamber 78A with water at the surface, before lowering the downhole tool 50 into the borehole 26. The method 150 also includes filling (block 154) the water side 94B of the lower volume chamber 78B with air at the surface. The lower volume chamber 78B may be open via the seal valve 96 at the sample side 92B to the guard flowline 74, which is open to the borehole 26 via one or both exit port valves 131. In addition, the method 150 includes running (block 156) the downhole tool 50 into the borehole 26, such as by lowering the downhole tool 50 via a wireline, drilling system, coiled tubing, or some other method. While running the downhole tool 50 into the borehole 26, the method 150 includes filling (block 158) the sample side 92B of the lower volume chamber 78B with borehole fluid to compress the air cushion in the water side 94B.

Upon reaching a desired depth, downhole tool 50 may sample (block 160) the formation fluid from the formation 12. To that end, the method 150 involves closing (block 162) the seal valve 96 of the lower volume chamber 78B to isolate the borehole fluid within the sample side 92B from the guard flowline 74, and closing (block 164) the exit port valve 131B of the upper exit-to-borehole module 130B. The method 150 may include pumping (block 166) formation fluid through the downhole tool 50 to clean the flowlines of the downhole tool 50 and to ensure that the formation fluid being sampled is a "clean" sample. Specifically, pumping (block 166) the formation fluid involves extending the probe 62 toward the formation wall, engaging the formation 12 via the probe 62, and using the pump 70 to draw fluid from the formation 12 into the sample flowline 72. The pump 70 urges the incoming formation fluid through the sample flowline 72, the U-turn, and into the guard flowline 74, before the formation fluid exits through the exit port valve 131A.

When the formation fluid being pumped through the downhole tool 50 is clean enough to be sampled, the method 150 includes closing (block 168) the seal valve 134 through the U-turn so that the formation fluid cannot flow between the two flowlines 72 and 74. Upon closing the seal valve 134, the two valves 96 of the upper volume chamber module 60A are opened. The pump 70 may continue to pump, thereby drawing the fluid from the sample side 92A of the upper volume chamber 78A, which pulls the piston 90A in the upward direction. This draws (block 170) the formation fluid from the formation 12 into the water side 94A of the upper volume chamber 78A. As more fluid is drawn from the sample side 92A, the piston 90A is pulled up, which draws the formation fluid into the water side 94A of the upper volume chamber 78A. Thus, the formation fluid within the water side 94A of the upper volume chamber 78A displaces the water, and the water is ejected to the borehole 26 via the exit port valve 131A.

As discussed above, it may be desirable to use the downhole tool 50 illustrated in FIG. 7 to re-inject sampled formation fluid back into the formation 12. Again, as mentioned above, the pump 70 is configured to pump fluids from a relatively lower pressure environment to a relatively higher pressure environment. However, the formation fluid stored in the downhole tool 50 may be at the same or at a relatively high pressure compared with the formation 12 into which the formation fluid may be injected. Accordingly, the downhole tool 50 of FIG. 7 uses the borehole fluid stored in the lower volume chamber 78B as a lower pressure fluid to be pumped through the downhole tool 50 in order to urge the higher pressure formation fluid back into the formation.

To that end, the method 150 includes blocks describing a process for re-injecting (block 172) formation fluid into the formation 12 after sampling the formation fluid as described above. The method 150 includes, for example, changing (block 174) a direction of the pumping operation performed by the pump 70. That is, instead of pumping fluid in a downward direction through the guard flowline 74, the pump 70 is configured to pump fluid in an upward direction through the guard flowline 74. In some embodiments, the borehole fluid pressure disposed in the sample side 92B of the lower volume chamber 78B may be low enough for the pump 70 to pump in the upward direction. In other embodiments, it may be desirable to lower the borehole fluid pressure so that the pump 70 is able to move the borehole fluid against a desired pressure differential. In order to lower this pressure, the method 150 may include closing the lower exit port valve 131A, opening the upper exit port valve 131B, and maintaining the seal valve 134 in a closed position to keep the fluid from moving between the flowlines 72 and 74. In this configuration, the downhole tool 50 is able to depressurize (block 176) the lower volume chamber 78B from hydrostatic pressure to the formation pressure via the pump 70. Once the lower volume chamber 78B is depressurized in this manner, the upper exit port valve 131B may be closed.

When the pressure is low enough in the lower volume chamber 78B, the method 150 includes opening (block 178) both seal valves 96 of the upper volume chamber 78A. This opens the sample side 92A of the upper volume chamber 78A to the guard flowline 74 and the water side 94A of the upper volume chamber 78A to the sample flowline 72. The method 150 then includes pumping (block 180) via the pump the lower pressure borehole fluid from the sample side 92B of the lower volume chamber 78B through the guard flowline 74 and to the sample side 92A of the upper volume chamber 78A. The pump 70 is configured to pump the borehole fluid from the relatively low pressure at the lower volume chamber 78B to a relatively higher pressure at the upper volume chamber 78A. This high pressure borehole fluid moves the piston 90A downward, which pushes (block 182) the formation fluid from the water side 94A of the upper volume chamber 78A through the sample flowline 72. From here the higher pressure formation fluid flows through the probe 62 back into the formation 12. Thus, the downhole tool 50 may re-inject relatively high pressure formation fluid back into the formation 12 after sampling the formation fluid. This formation fluid, at injection, may have an injection pressure that is above formation pressure but below the hydrostatic pressure at which the pump 70 operates. In other embodiments, if the permeability of the fluid is sufficiently low, the injection pressure at a desired injection rate may be higher than the hydrostatic pressure of the pump 70. In such cases, the pump 70 may be used directly to pull the fluid from the borehole 26 and to expel the fluid from the pump 70 at a pressure above hydrostatic pressure.

It should be noted that the operations of the illustrated method 150 may be carried out multiple times during the time the downhole tool 50 is disposed in the borehole 26. For example, the sampling of formation fluids and subsequent re-injection of the sampled fluid may be performed at multiple stations along the length of the borehole 26. This may enable the same downhole tool 50 to sample formation fluid and run downhole tests on the formation fluid at multiple points along the length of the borehole 26, without having to bring up a large amount of formation fluid when the downhole tool 50 is removed from the borehole 26. It should be noted that, in some embodiments, the downhole tool 50 may be used to sample formation fluids without later re-injecting the formation fluids into the formation 12.

In some embodiments, the sampling and re-injection operation of the downhole tool 50 described above may be limited by a differential pressure capacity of the pump 70. That is, the pump 70 may be configured to pump fluids from a lower pressure to a formation pressure that is approximately 11-15 kpsi higher than the lower pressure.

Figure 9:
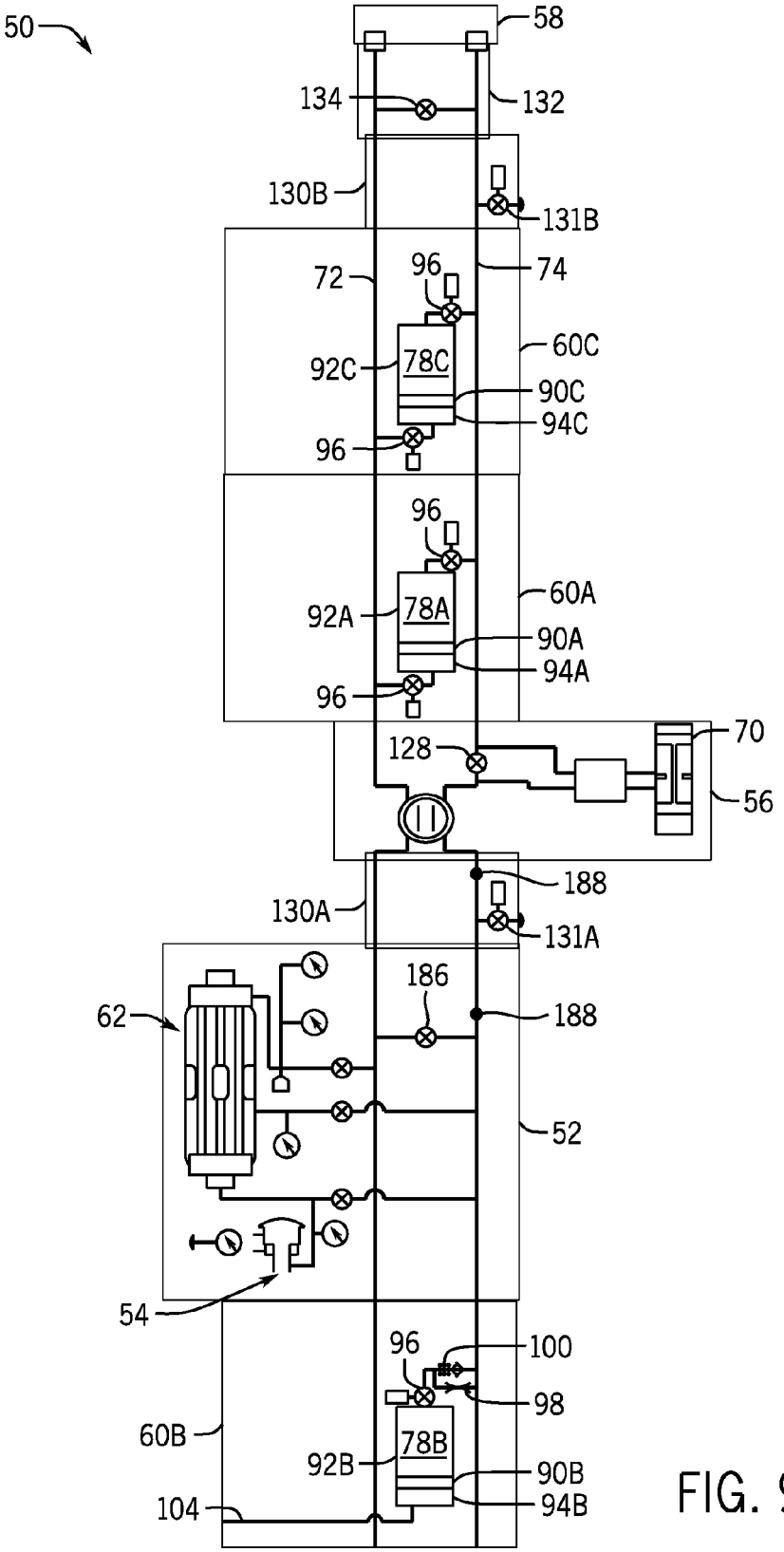
FIG. 9 is a schematic diagram of a downhole tool having bulk volume chambers for sampling formation fluids and injecting chemicals into the formation in accordance with an embodiment of the present techniques.

Sampling Fluid, Injecting Chemicals, and Re-Injecting Sampled Fluid into Formation Another embodiment of the downhole tool 50 that allows controlled injection into the formation 12 is illustrated in FIG. 9. This embodiment of the downhole tool 50 may offer additional functionalities. For example, the illustrated embodiment may be used to sample formation fluid into a bulk chamber (e.g., volume chamber 78A), then inject a chemical into the formation followed by re-injection of the sampled fluid.

The illustrated embodiment of the downhole tool 50 is generally similar to the downhole tool 50 described above with reference to FIG. 7, but with an additional volume chamber module 60C. This additional volume chamber module 60C may be disposed between the original upper volume chamber module 60A and the exit-to-borehole module 130B. However, in other embodiments, other relative arrangements of these components may be possible.

As discussed at length above, the formation fluid may be pumped from the formation 12 and sampled into the water side 94A of the volume chamber 78A. The additional volume chamber module 60C includes a second upper volume chamber 78C coupled to each of the flowlines 72 and 74 via respective seal valves 96, similar to the first upper volume chamber 78A. The second upper volume chamber 78C may be filled with acid, or some other formation property altering fluid, brought down from the surface. The formation property altering fluid may include, for example, a fluid designed to increase the permeability or wettability of the formation 12 when injected into the formation 12. In the illustrated embodiment, the lower volume chamber 78B is equipped with the seal valve 96 on the sample side 92B in series with the parallel flow restrictor 98 and the relief valve 100. The water side 94B is coupled via the open connection 104 to the borehole 26. This arrangement of the lower volume chamber module 60B is similar to that shown in FIG. 3. In other embodiments, the flow restrictor 98 and relief valve 100 pair may be replaced with a motor seal valve capable of throttling the flow of water out of the lower volume chamber 78.

When fluid is to be injected into the formation 12 using this embodiment of the downhole tool 50, the seal valve 96 at the top of the lower volume chamber 78B may be opened to allow water to flow out or be pumped out of the sample side 92B of the lower volume chamber 78B. The pump 70 may draw water from the sample side 92B of the lower volume chamber 78B and push this water into the sample side (e.g., 92A or 92C) of one of the upper volume chambers 78A and 78C. The flow restrictor 98 in the lower volume chamber module 60B creates a pressure drop, resulting in a lower pressure of the water being drawn into the guard flowline 74 below the pump 70. More specifically, the flow restrictor 98 restricts the flow of water from the lower volume chamber 78B to starve the pump 70, thereby reducing a pressure through the guard flowline 74 below the pump 70. This may enable the pump 70 to push the water from the lower pressure guard flowline 74 into the higher pressure sample side of the upper volume chamber (e.g., 78A or 78C) in a controlled manner. The water being pumped into the upper volume chambers 78A and 78C then displaces the fluid stored in the water side (e.g., 94A or 94C) of these upper volume chambers. Consequently, the pump 70 is able to push the higher pressure fluid (e.g., sampled formation fluid or acid) from the water sides 94A and 94C through the sample flowline 72 and the probe 62 back into the formation 12 at a pressure higher than formation pressure, but lower than hydrostatic pressure.

In some embodiments, the flow restrictor 98 may be configured to create a restriction that limits the flow rate of the water out of the lower volume chamber 78B as a function of a desired pressure drop. One such type of flow restrictor 98 may include a VISCOJET® flow restrictor made by The Lee Company of Westbrook, Conn.

In some embodiments, once the seal valve 96 of the lower volume chamber 78B is opened, the hydrostatic pressure of the fluid in the water side 94B of the lower volume chamber 78B may be high enough that the fluid pushes the water out of the sample side 92B of the lower volume chamber 78B without the use of the pump 70. In some embodiments, the flow resistor 98 may be a constant flow rate flow restrictor, which restricts the flow of water from the sample side 92B to a constant flow rate as it flows into the guard flowline 74. However, in other embodiments, the flow restrictor 98 may not be configured to maintain the water exiting the sample side 92B at a constant flow rate. In such embodiments, a piston position sensor may be disposed adjacent the piston 90B to monitor the position of the piston 90B and, consequently, to calculate the injection rate of the water through the flow restrictor 98. Furthermore, in some embodiments, the downhole tool 50 may be equipped with fluid monitoring devices in both flowlines 72 and 74, such as between the probe 62 and the volume chambers 78 to measure resistivity, density, or other fluid properties of the fluid flowing therethrough.

Figure 10:
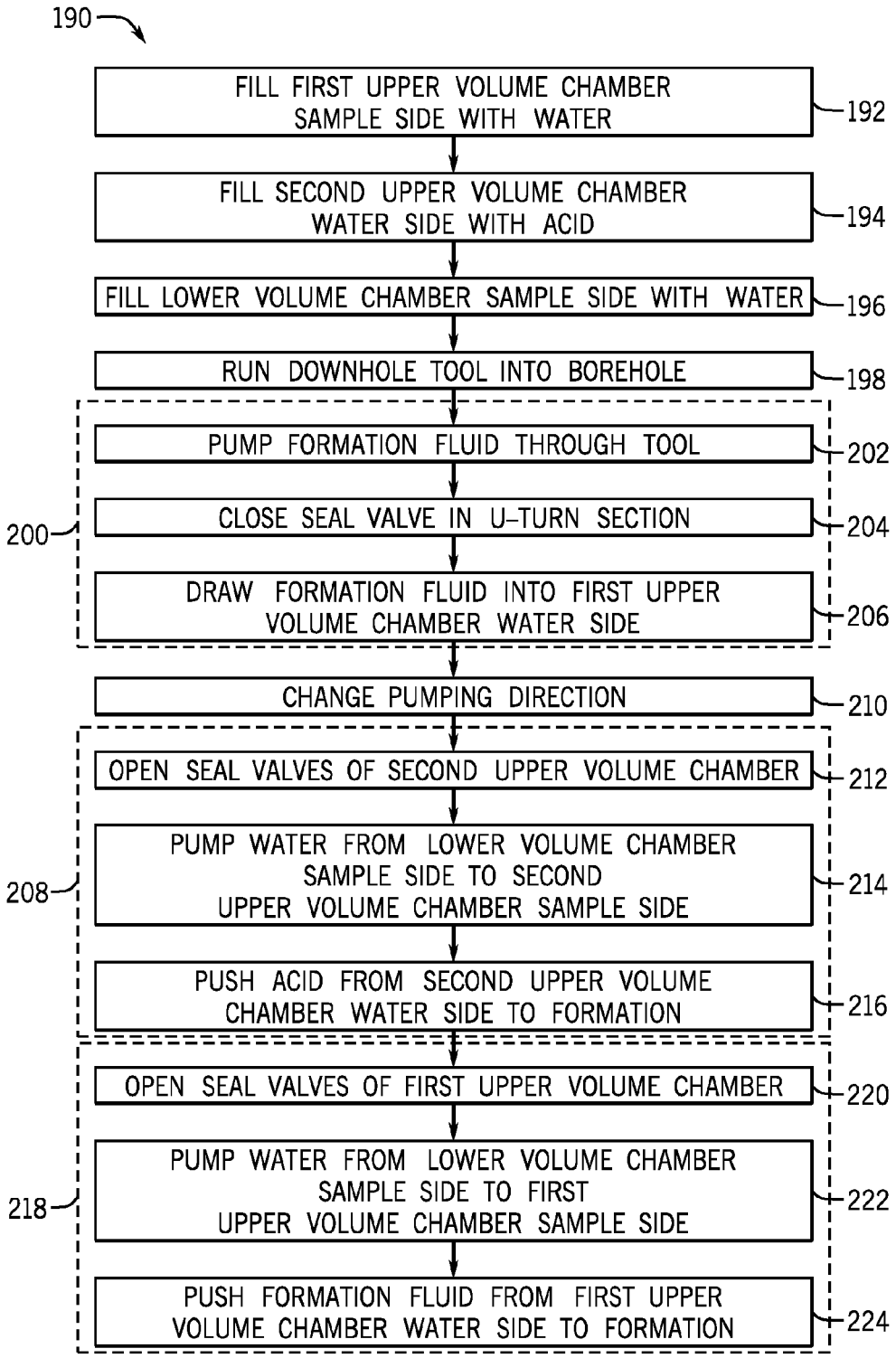
FIG. 10 is a process flow diagram of a method for operating the downhole tool of FIG. 9 to sample formation fluid, inject acid, and re-inject the formation fluid, in accordance with an embodiment of the present techniques.

As briefly mentioned above, the downhole tool 50 illustrated in FIG. 9 may be used to sample formation fluid into the first upper volume chamber 78A, inject a chemical (e.g., acid) into the formation 12 from the second upper volume chamber 78C, and re-injecting the sampled formation fluid from the upper volume chamber 78A back into the formation 12. FIG. 10 is a process flow diagram of a method 190 for performing this set of operations using the downhole tool 50 illustrated in FIG. 9. The method 190 includes filling (block 192) the sample side 92A of the first upper volume chamber 78A with water (or oil) at the surface, before lowering the downhole tool 50 into the borehole 26. The method 190 also includes filling (block 194) the water side 94C of the second upper volume chamber 78C with acid (or some other formation property altering substance) at the surface, before lowering the downhole tool 50 into the borehole 26. The method 190 further includes filling (block 196) the sample side 92B of the lower volume chamber 78B with water at the surface, while leaving the backside (e.g., water side 94B) of the piston 90B open to hydrostatic pressure via the open connection 104. The seal valves 96 used to isolate the sample sides 92A, B, and C of each of the upper and lower volume chambers 78A, 78B, and 78C are closed prior to lowering the downhole tool 50 into the borehole 26.

In addition, the method 190 includes running (block 198) the downhole tool 50 into the borehole 26, such as by lowering the downhole tool 50 via a wireline, drilling system, coiled tubing, or some other method. Since the water side 94B of the lower volume chamber 78B is open to hydrostatic pressure, the pressure may increase in the water side 94B as the downhole tool 50 is lowered into the borehole 26.

Upon reaching a desired depth, downhole tool 50 may sample (block 200) the formation fluid from the formation 12. To that end, the method 190 includes closing the exit port valve 131B at the top of the downhole tool 50. The method 190 also includes pumping (block 202) formation fluid through the downhole tool 50 to clean the flowlines of the downhole tool 50 and to ensure that the formation fluid being sampled is a "clean" sample. Specifically, pumping (block 202) the formation fluid involves extending the probe 62 toward the formation wall, engaging the formation 12 via the probe 62, and using the pump 70 to draw fluid from the formation 12 into the sample flowline 72. The pump 70 urges the incoming formation fluid through the sample flowline 72, the U-turn, and into the guard flowline 74, before the formation fluid exits through the exit port valve 131A.

When the formation fluid being pumped through the downhole tool 50 is clean enough to be sampled, the method 190 includes closing (block 204) the seal valve 134 through the U-turn so that the formation fluid cannot flow between the two flowlines 72 and 74 and the valves 96 are opened. The pump 70 may continue to pump. This draws the water from the sample side 92A of the first upper volume chamber 78A. As more water is drawn into the sample side 92A, the piston 90A is pulled upward, which draws (block 206) the formation fluid through the sample flowline into the water side 94A of the upper volume chamber 78A. Thus, the formation fluid within the water side 94A of the upper volume chamber 78A displaces the water, and the water is ejected to the borehole 26 via the exit port valve 131A. Once sampling is complete, the method 190 includes closing the seal valve 96 between the water side 94A of the first upper volume chamber 78A and the sample flowline 72.

As discussed above, it may be desirable to use the downhole tool 50 illustrated in FIG. 9 to inject acid, or some other formation property altering fluid, into the formation 12 and to re-inject sampled formation fluid back into the formation 12. Both of these processes involve moving relatively high pressure fluids (e.g., sampled formation fluid, acid provided from the surface) from a higher (hydrostatic) pressure environment of the downhole tool 50 to a lower pressure environment of the formation 12. Accordingly, the downhole tool 50 of FIG. 9 may utilize the water from the lower volume chamber 78B as a lower pressure fluid to be pumped through the downhole tool 50 in order to urge the higher pressure formation fluid and/or acid into the formation 12.

The method 190 includes a process for injecting (block 208) a chemical (acid or other) into the formation 12 to alter formation properties. The method 190 may include, for example, changing (block 210) a direction of the pumping operation performed by the pump 70. That is, instead of pumping fluid in a downward direction through the guard flowline 74, the pump 70 is configured to pump fluid in an upward direction through the guard flowline 74. The method 190 also includes opening (block 212) both seal valves 96 of the second upper volume chamber 78C. This opens the sample side 92C of the second upper volume chamber 78C to the guard flowline 74 and the water side 94C of the second upper volume chamber 78C to the sample flowline 72. The method 190 then includes opening the seal valve 96 of the lower volume chamber 78B and pumping (block 214) via the pump 70 the water from the sample side 92B of the lower volume chamber 78B through the guard flowline 74 and to the sample side 92C of the second upper volume chamber 78C.

As mentioned above, in some embodiments the hydrostatic pressure in the water side 94B of the lower volume chamber 78B may force the water out of the sample side 92B through the flow restrictor 98 once the seal valve 96 is opened. In such cases, the water may flow from the sample side 92B of the lower volume chamber 78B to the sample side 92C of the second upper volume chamber 78C without the pump 70 actively operating to pump the water. This passive method of flow control may be possible by using a flow restrictor 98 configured to restrict the flow to achieve a desired constant pressure drop. That way, as long as the pressure drop across the flow restrictor does not lower the injection pressure of the water exiting through the flow restrictor 98 to below hydrostatic pressure, the water will flow to the sample side 92 of the appropriate upper volume chamber 78A or 78C.

The pump 70 is configured to pump the water from the relatively low pressure at which it exits the lower volume chamber 78B to a relatively higher pressure at the upper volume chamber 78A. This water moves the piston 90C downward, which pushes (block 216) the formation altering chemical (e.g., acid) from the water side 94C of the second upper volume chamber 78C through the sample flowline 72. From here the higher pressure acid flows through the probe 62 and into the formation 12. Thus, the downhole tool 50 may inject relatively high pressure acid or other formation altering fluids into the formation 12.

In addition, the downhole tool 50 illustrated in FIG. 9 is configured to re-inject (block 218) the formation fluid sampled from the formation 12 back into the formation 12 according to the following description. The method 190 includes opening (block 220) both seal valves 96 of the upper volume chamber 78A. This opens the sample side 92A of the upper volume chamber 78A to the guard flowline 74 and the water side 94A of the upper volume chamber 78A to the sample flowline 72. The method 190 then includes pumping (block 222) via the pump 70, or letting the hydrostatic pressure push, the lower pressure water from the flow restrictor 98 at the sample side 92B of the lower volume chamber 78B through the guard flowline 74 and to the sample side 92A of the upper volume chamber 78A. The pump 70 is configured to pump the water from the relatively low pressure at the flow restrictor 98 to a relatively higher pressure at the upper volume chamber 78A. This high pressure water moves the piston 90A downward, which pushes (block 224) the formation fluid from the water side 94A of the upper volume chamber 78A through the sample flowline 72. From here the higher pressure formation fluid flows through the probe 62 back into the formation 12. Thus, the downhole tool 50 may re-inject relatively high pressure formation fluid back into the formation 12 after sampling the formation fluid.

It should be noted that the operations of the illustrated method 190 may be carried out multiple times during the time the downhole tool 50 is disposed in the borehole 26. For example, the sampling of formation fluids and subsequent re-injection of the sampled fluid, in addition to injection of acid, may be performed at multiple stations along the length of the borehole 26. This may enable the same downhole tool 50 to sample formation fluid, run downhole tests on the formation fluid, and add formation altering chemicals to the formation 12 at multiple points along the length of the borehole 26. In some embodiments, the downhole tool 50 may be configured to replenish the supply of water in the lower volume chamber 78B used to push formation fluid, acids, or other fluids into the formation 12. For example, after the fluids have been output to the formation 12 as desired, the pump operation may be switched in order to direct the water from the sample side 92 of one or both of the upper volume chambers 78A and 78C back to the sample side 92B of the lower volume chamber 78B. The relief valve 100 may be positioned to allow the water to flow with relative ease at a rate determined by the pump 70 and not limited by the flow restrictor 98. In other embodiments, the lower volume chamber 78B may be re-charged with borehole or formation fluid. However, in such embodiments, it may be desirable to include a throttling motor seal valve instead of the flow restrictor 98, due to the limited solids tolerance of the flow restrictor 98.

The disclosed embodiments of the downhole tool 50 may include a wide variety of number, sizes, and arrangements of volume chambers 78. For example, the volume chambers 78 may generally be available in three sizes: 3 Liters, 10 Liters, and 25 Liters. However, in other embodiments, different sizes of volume chambers 78 may be utilized. For example, the volume chambers 78 may be sized to support a fluid volume of approximately 3 Liters to 25 Liters. It should be noted that the volumes that can be handled by the volume chambers 78 described herein are larger than the volumes of fluids that can be handled in traditional flow control modules configured to provide flowback control. The different volumes of volume chambers 78 may be used together in any desired combination to provide the appropriate volume of fluid flow between the different parts of the downhole tool 50. As an example, the downhole tool 50 illustrated in FIG. 9 may be equipped with a 3 Liter volume chamber for each of the upper volume chambers 78A and 78C and with a 10 Liter volume chamber for the lower volume chamber 78B. If greater volumes of fluids are desired, larger sizes of volume chambers 78 may be used. In some embodiments, if greater volumes of water are desired for injecting the water to push fluids out of the upper volume chambers 78A and 78C, additional lower volume chambers 78B (e.g., a second, third, fourth, etc.) may be added to support the injection process.

Detecting Viscosity of Heavy Oils or Emulsions Using a Downhole Tool with Two Flowlines In addition to the processes of sampling and injecting fluids using the presently disclosed downhole tool 50, in some embodiments, the downhole tool 50 may be configured to provide additional functionalities relating to detecting properties of heavy oils or emulsions. Such processes performed using existing tools involve directing heavy oils/emulsions through a small tube to one or more sensors used to determine a viscosity of the heavy oil/emulsion. It is now recognized that heavy oils or emulsions may not be placed in some small diameter flowlines or tubes due to flow resistance, and cleaning of such sensors following the viscosity measurements may be difficult.

In the embodiments disclosed herein, the two flowlines 72 and 74 may be used for detecting the viscosity of heavy oils or emulsions that may be sampled from the formation 12. The heavy oil/emulsion may be sampled from the formation 12 and captured in one of the volume chambers 78, or in the sample flowline 72. The seal valve 134 through the U-turn may be opened, connecting the flowlines 72 and 74. In some embodiments, a second U-turn may be present between the sample flowline 72 and the guard flowline 74. For example, in the illustrated embodiment, another U-turn with a valve 186 is disposed between the flowlines 72 and 74 in the probe module 52. In other embodiments, the second U-turn may be disposed anywhere along the length of the downhole tool 50 that is on the opposite side of the pump 70 from the first U-turn. The valve 186 may be opened along with the seal valve 134, and the pump 70 may pump the sampled heavy oil/emulsion through the sample flowline 72, the first U-turn (134), the guard flowline 74, and the second U-turn (186). In this manner, the pump 70 is able to circulate the heavy oil/emulsion through the two flowlines 72 and 74 of the downhole tool 50.

In order to calculate the viscosity of the heavy oil/emulsion being circulated through the downhole tool 50, the downhole tool 50 may include sensors 188 used to determine a pressure drop through a portion of the circulation path. Such sensors 188 may include pressure sensors, fluid analyzer, or some other sensors positioned at two points along the circulation path. For example, the sensors 188 may be disposed along the guard flowline 74, as illustrated. Any other desirable placement of the sensors 188 may be used in other embodiments. Based on known dimensions of the flowpath between the sensors 188, the pressure drop measured between the sensors 188, and a measured flow rate of the heavy oil/emulsion being pumped through the flowpath via the pump 70, a processor of the downhole tool 50 may calculate the viscosity of the heavy oil/emulsion flowing therethrough. The flow rate may be measured via a flowmeter along the fluid circulation path or a position sensing mechanism used to measure a position of a piston in one of the volume chambers 78 or the pump 70.

It should be noted that the downhole tool 50 may be configured to perform various operations involving sampled heavy oils or emulsions. For example, in some embodiments, the heavy oil or emulsion may be sampled into the downhole tool 50, pumped through the circulating flowpath via the pump 70 so that the viscosity may be sensed during this circulation, and pumped into one of the volume chambers 78 for later use. In certain embodiments, two or more sample chambers 78 may be disposed along the sections of the flowpaths 72 and 74 that make up the fluid circulation flowpath (e.g., between the two U-turns). In this arrangement, the downhole tool 50 may be configured to circulate the heavy oil/emulsion through the circulation flowpath, measure the viscosity of the heavy oil/emulsion, inject a chemical (e.g., solvent, emulsion breaker) from one or more of the volume chambers 78 into the heavy oil/emulsion, and recirculate the heavy oil/emulsion and chemical mixture through the circulation flowpath to determine the viscosity of the new mixture. Furthermore, these viscosity measurement operations may be combined with any other desirable operations of the present disclosure, including sampling formation fluids, re-injecting fluids, and adding chemicals and tracers to formation fluid, among others.

Enhanced Oil Recovery Processes Using a Downhole Tool with Volume Chambers

Figure 11:
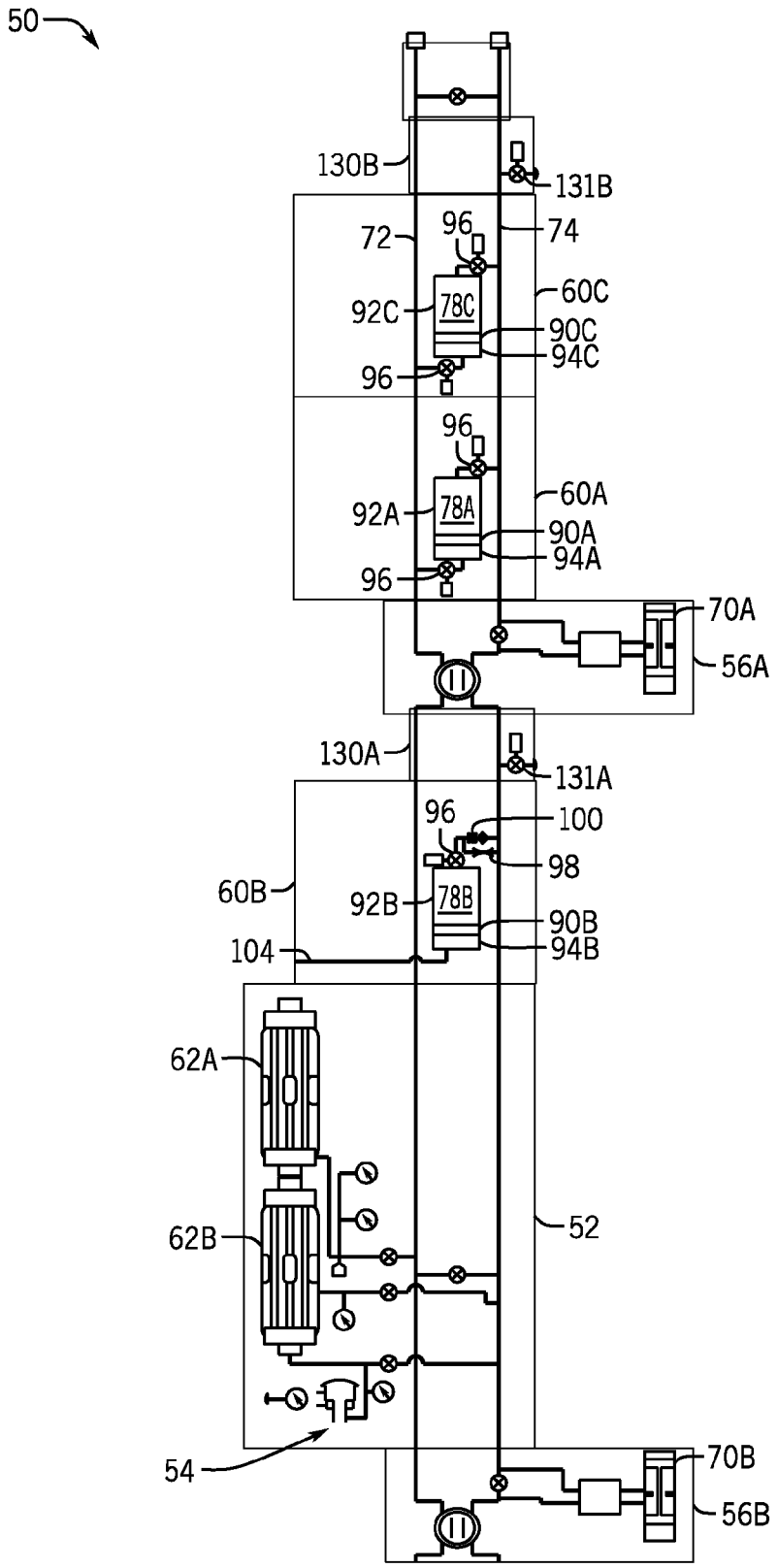
FIG. 11 is a schematic diagram of a downhole tool having bulk volume chambers for enhanced oil recovery analysis in accordance with an embodiment of the present techniques.

Additional applications and enhanced oil recovery analyses may be performed using other embodiments of the downhole tool 50. As an example of this, FIG. 11 illustrates an embodiment of the downhole tool 50 that uses similar methods as those described above to control injection pressure, but for different applications. Specifically, the illustrated embodiment includes two formation interface devices, which are hereinafter referred to as upper probe 62A and lower probe 62B. Using two probes 62 instead of one provides additional functionalities than are available through previously discussed embodiments of the downhole tool 50.

The downhole tool 50 illustrated in FIG. 11 includes two probes 62A and 62B, and these two probes 62A and 62B may be arranged as part of the same probe module 52. However, in other embodiments, the probes 62A and 62B may be disposed each in their own separate probe module 52. These two probes 62 may enable the downhole tool 50 to simultaneously output fluid into the formation 12 with one probe (e.g., 62A) while drawing fluid from the formation 12 into the downhole tool 50 with the other probe (e.g., 62B). In addition to the two probes 62, the downhole tool 50 includes two pump modules 56A and 56B for pumping fluid through the downhole tool 50. In the illustrated embodiment, the various modules are configured and arranged similarly to the downhole tool 50 of FIG. 9. However, the lower volume chamber 78B in FIG. 11 is disposed above the probe module 52 in the illustrated embodiment. The additional lower pump module 56B is disposed below the probe module 52.

The two-probe, two-pump configuration of the downhole tool 50 in FIG. 11 may be used to perform a variety of different enhanced oil recovery functions. For example, using the downhole tool 50 of FIG. 11, it may be possible to inject a tracer from a dedicated volume chamber (e.g., upper volume chamber 78C) into one formation interface between the formation 12 and the probe 62A. The tracer may be a known tracer fluid that is pre-filled into the upper volume chamber 78C at the surface. The upper pump 70A may be used to inject the tracer into the formation 12 while the lower pump 70B draws fluid into the downhole tool 50 from the formation 12 at the second probe 62B. The downhole tool 50 may be configured with sensors to determine and record a time and pressure that it takes for the tracer to move from one formation interface (e.g., probe 62A) to another (e.g., probe 62B).

Figure 12:
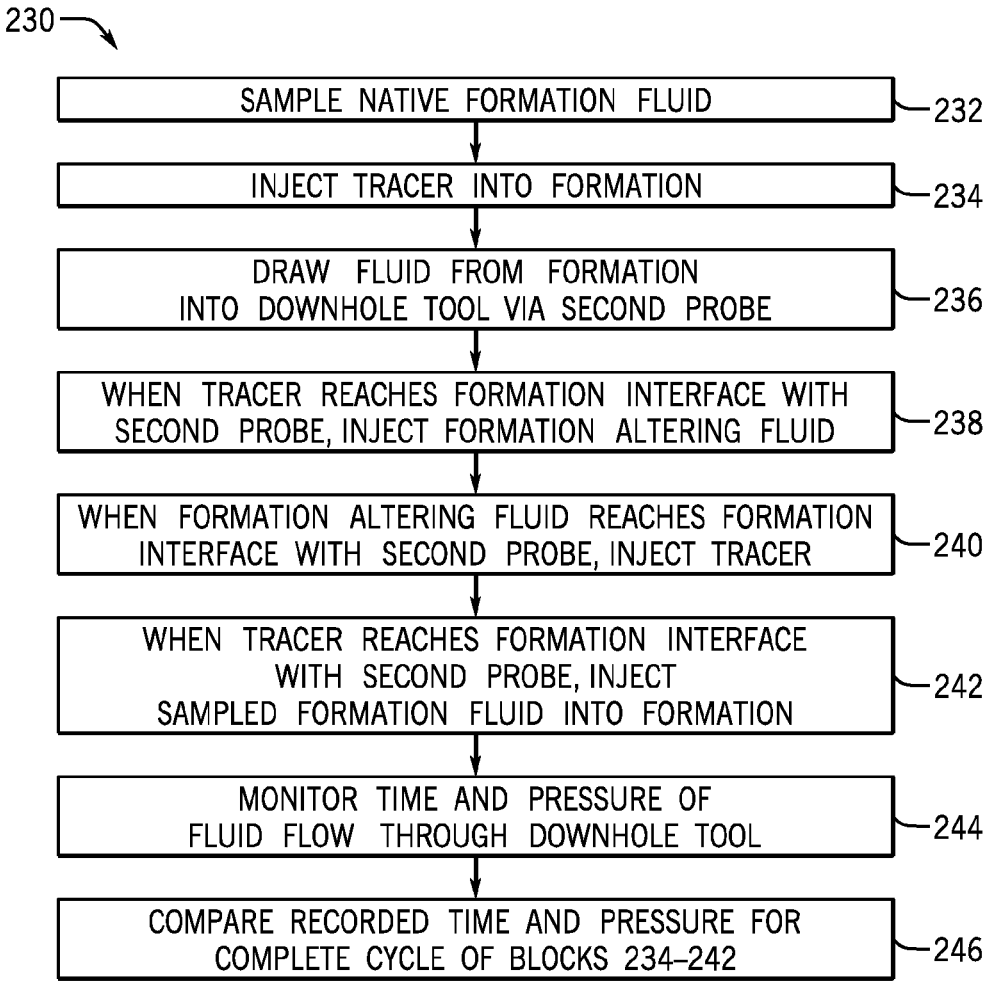
FIG. 12 is a process flow diagram of a method for performing enhanced oil recovery analysis using the downhole tool of FIG. 11, in accordance with an embodiment of the present techniques.

FIG. 12 is a process flow diagram of one method 230 for operating the downhole tool 50 in this manner. The method 230 includes sampling (block 232) the native formation fluid from the formation 12. This is the formation fluid that is present within the formation 12 prior to the downhole tool 50 adding chemicals, tracers, or other fluids into the formation 12. The method 230 also includes injecting (block 234) a fluid (e.g., tracer) into the formation 12 via the probe 62A while drawing (block 236) a fluid into the downhole tool 50 via the probe 62B. In addition, the method 230 includes, when the tracer reaches the interface of the formation 12 with the lower probe 62B, injecting (block 238) a formation altering chemical (e.g., acid) into the formation 12 via the probe 62A while continuing to draw fluid from the formation 12 into the downhole tool 50 via the probe 62B. The method 230 further includes, when the formation altering chemical reaches the interface of the formation 12 with the lower probe 62B, injecting (block 240) the tracer into the formation 12 via the probe 62A while continuing to draw fluid from the formation 12 into the downhole tool 50 via the probe 62B. When the tracer reaches the interface of the formation 12 and the probe 62B, the method 230 includes injecting (block 242) sampled formation fluid into the formation 12 via the probe 62A while continuing to draw formation fluid into the downhole tool 50 via the probe 62B.

Throughout the parts of the method 230 described above, the downhole tool 50 may be monitoring (block 244) time, as well as pressure within one or more of the flowlines 72 and 74, the volume chambers 78, the pumps 70, or the probes 62 to determine a pressure change within the downhole tool 50. The method 230 may also include comparing (block 246) the recorded pressure and time in the cycle between blocks 234 and 242. Additionally, the downhole tool 50 may include fluid monitoring devices disposed in both flowlines 72 and 74 to measure resistivity and density, or other fluid properties of the fluids that are pumped into and out of the formation 12. The fluid monitoring devices may be disposed, for example, between the formation interfaces of the probes 62 and the volume chambers 78 located above the probe module 52.

Figure 13:
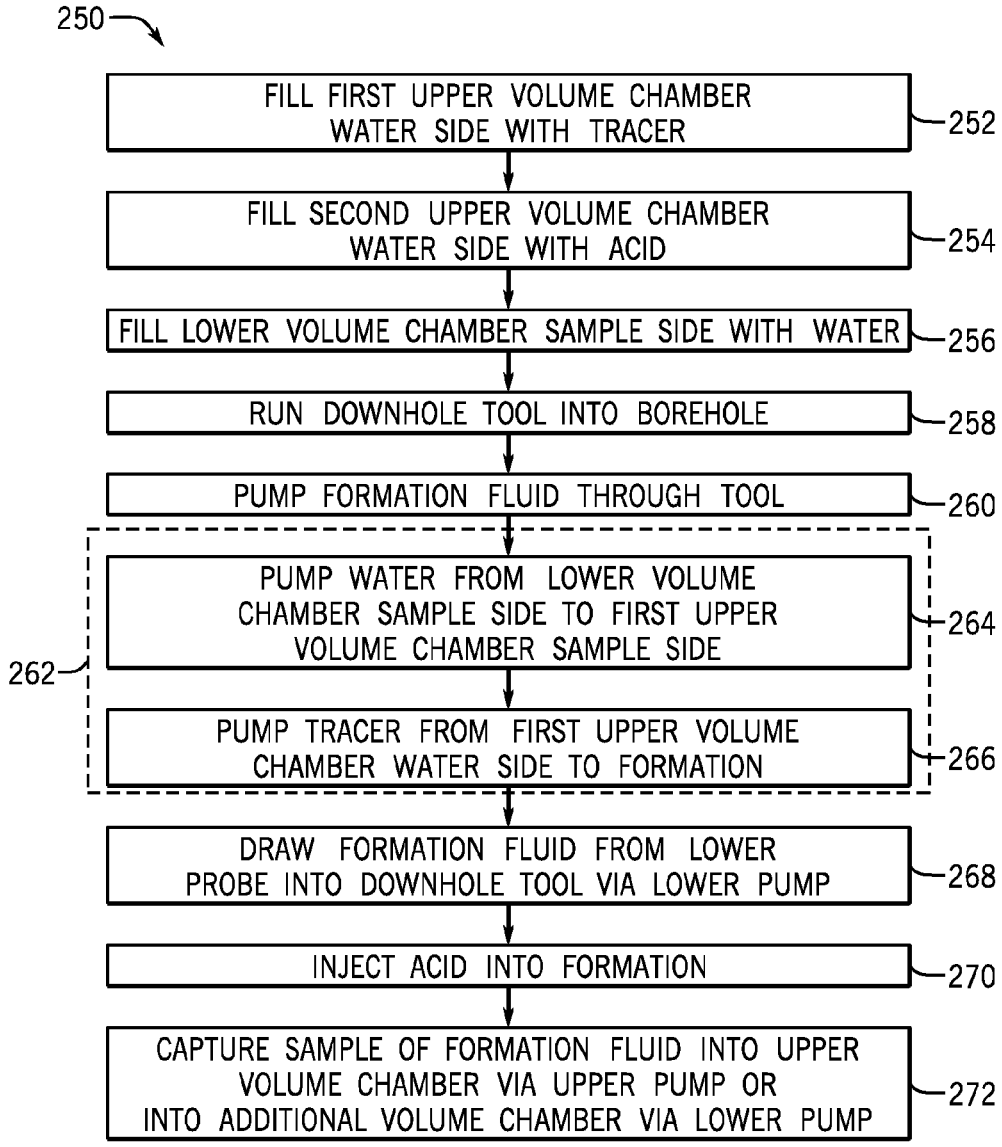
FIG. 13 is a process flow diagram of a method for operating the downhole tool of FIG. 11 to perform the method outlined in FIG. 12, in accordance with an embodiment of the present techniques.

A more detailed description of the functions performed in the method 230, along with other applications, is provided below. FIG. 13 is a process flow diagram of a method 250 for providing enhanced oil recovery analysis using the downhole tool 50 of FIG. 11. The method 250 includes filling (block 252) the water side 94A of the first upper volume chamber 78A with a tracer at the surface, before lowering the downhole tool 50 into the borehole 26. The method 250 also includes filling (block 254) the water side 94C of the second upper volume chamber 78C with acid at the surface, before lowering the downhole tool 50 into the borehole 26. The method 250 further includes filling (block 256) the sample side 92B of the lower volume chamber 78B with water at the surface, while leaving the backside (e.g., water side 94B) of the piston 90B open to hydrostatic pressure via the open connection 104. The seal valves 96 used to isolate the water sides 94A and 94C of each of the upper volume chambers 78A and 78C are closed prior to lowering the downhole tool 50 into the borehole 26.

The method 250 also includes running (block 258) the downhole tool 50 into the borehole 26, such as by lowering the downhole tool 50 via a wireline, drilling system, coiled tubing, or some other method. Since the water side 94B of the lower volume chamber 78B is open to hydrostatic pressure, the pressure may increase in the water side 94B as the downhole tool 50 is lowered into the borehole 26. At this point, the seal valves 96 on the sample sides 92A and 92C of the upper volume chambers 78A and 78C are open, the seal valve 134 at the U-turn between the flowlines 72 and 74 is open, and the upper and lower exit port valves 131B and 131A are open.

Upon reaching a desired depth, downhole tool 50 may clean the downhole tool using formation fluid from the formation 12. To that end, the method 250 includes closing the exit port valve 131B at the top of the downhole tool 50, as well as the seal valves 96 on the sample sides 92A and 92C of the upper volume chambers 78A and 78C. The method 250 also includes pumping (block 260) formation fluid through the downhole tool 50 to clean the flowlines of the downhole tool 50 and to ensure that the formation fluid being sampled is a "clean" sample. Specifically, pumping (block 260) the formation fluid involves extending the probe 62 toward the formation wall, engaging the formation 12 via one of the probes 62, and using the upper pump 70A to draw fluid from the formation 12 into the sample flowline 72. The pump 70A urges the incoming formation fluid through the sample flowline 72, the U-turn, and into the guard flowline 74, before the formation fluid exits through the open exit port valve 131A.

The method 250 also includes injecting (block 262) the tracer from the upper volume chamber 78A into the formation 12. This may involve closing the lower exit port valve 131A, opening the seal valve 96 on the sample side 92B of the lower volume chamber 78B, opening the seal valve 96 on the sample side 92A of the first upper volume chamber 78A. Specifically, the method 250 includes pumping (block 264) the water (or oil) from the sample side 92B of the lower volume chamber 78B to the sample side 92A of the upper volume chamber 78A via the first pump 70A. This water moves the piston 90A downward, which pushes (block 266) the tracer from the water side 94A of the first upper volume chamber 78A through the sample flowline 72. From here the higher pressure tracer flows through the upper probe 62A and into the formation 12. Thus, the downhole tool 50 may inject the relatively high pressure tracer into the formation 12.

While injecting (block 262) the tracer via the upper pump 70A and the upper probe 62A, the method 250 may include drawing (block 268) formation fluid from the lower probe 62B into the downhole tool 50 via the lower pump 70B. The method 250 may also include injecting (block 270) acid into the formation 12. This may involve the same process as described above with respect to injecting (block 262) the tracer, except when injecting (block 270) the acid the upper pump 70A pumps the acid from the water side 94C of the second upper volume chamber 78C, instead of a tracer from the first upper volume chamber 78A.

As described above with reference to FIG. 12, these various sampling and injection (blocks 262 and 270) processes may be applied in a desired sequence to administer and measure the results of enhanced oil recovery treatments (e.g., via the addition of acid). In some embodiments, the method 250 may include capturing (block 272) a reverse lowshock sample of the formation fluid into one of the upper volume chambers 78A or 78C via the upper pump 70A. Other embodiments of the downhole tool 50 may include a fourth volume chamber 78 (not shown) between the probe module 52 and the lower pump 70B, and the method may include capturing (block 272) the sample of formation fluid into this fourth volume chamber 78 via the lower pump 70B. This sampled fluid may later be re-injected into the formation 12 after the tracer and/or acid treatment is provided, in order to determine the effectiveness of the enhanced oil recovery treatment.

As described in detail above with respect to FIG. 12, the enhanced oil recovery treatment available through the downhole tool 50 of FIG. 11 may include a number of sampling and injection cycles. The injection cycle could be carried out first with a tracer carried from the surface in the first upper volume chamber 78A. This may establish a baseline time and pressure difference for a single injection cycle. The injection cycle refers to injecting the tracer into the formation and detecting the tracer via the downhole tool 50 when the lower probe 62B draws in the formation fluid with the tracer. A second injection cycle may contain a chemical (e.g., acid) to alter specific properties of the formation 12. This acid may be carried from the surface in the second upper volume chamber 78C. Although this description states that the tracer is carried in the first upper volume chamber 78A and the acid is carried in the second upper volume chamber 78C, the fluids may be disposed in the reverse volume chambers in other embodiments. A third injection cycle may be performed with the tracer to compare to the first cycle, and a fourth injection cycle may be performed using formation fluid sampled from the formation 12 at an earlier time frame to ensure the native formation fluid of the sample is not contaminated with tracer or acid. As noted above, this formation fluid sample may be stored in the second upper volume chamber 78C after the acid is injected, or stored in a third upper volume chamber (not shown in FIG. 11).

It should be noted that the embodiments of the downhole tool 50 described above with reference to FIGS. 7, 9, and 11 may also be used to inject fluids into the formation 12 that are traditionally more difficult to pass through a downhole pump (e.g., pump 70). Such fluids may be brought down into the borehole 26 from the surface in one of the volume chambers 78, similar to the above described tracers or formation altering chemicals described at length above. These difficult to pump fluids may include, for example, propends, fluid with fibers disposed therein, and fluids with high solids content, among others. Propend injection may be particularly desirable when combined with micro-frac operations, as these fluids can be used to keep open a fracture after an initial fracturing and propagation. When the injection pressure is expected to be higher than hydrostatic pressure, the flow restrictor may be removed from the lower volume chamber 78B, or fluid can be pumped from the borehole 26 instead of from the lower volume chamber 78B.

Controlling Flowback from Formation after Micro-Frac Operations

The disclosed embodiments of the downhole tool 50 having two flowlines 72 and 74 and multiple volume chambers 78 disposed along the flowlines 72 and 74 may also be used in micro-frac operations. As noted above, micro-frac operations involve injecting fluids into the formation 12 to break open a portion of the formation 12. After a formation fracture is initiated and propagated by pumping fluid into formation 12 via the downhole tool 50, interpretation of a pressure decline as the injected fluid flows off the formation 12 may yield the formation minimum horizontal stress. However, in non-permeable formations such as shale or tight formations, the injected fluid may not leak off at all, or not at a rate sufficient to allow measurement and interpretation via the downhole tool 50. A slow and controlled fluid flow back into the downhole tool 50 is desired in such a situation. Since existing reciprocating pumps cannot control fluid flow from high to low pressure, they are unsuitable for such operations.

Figure 14:
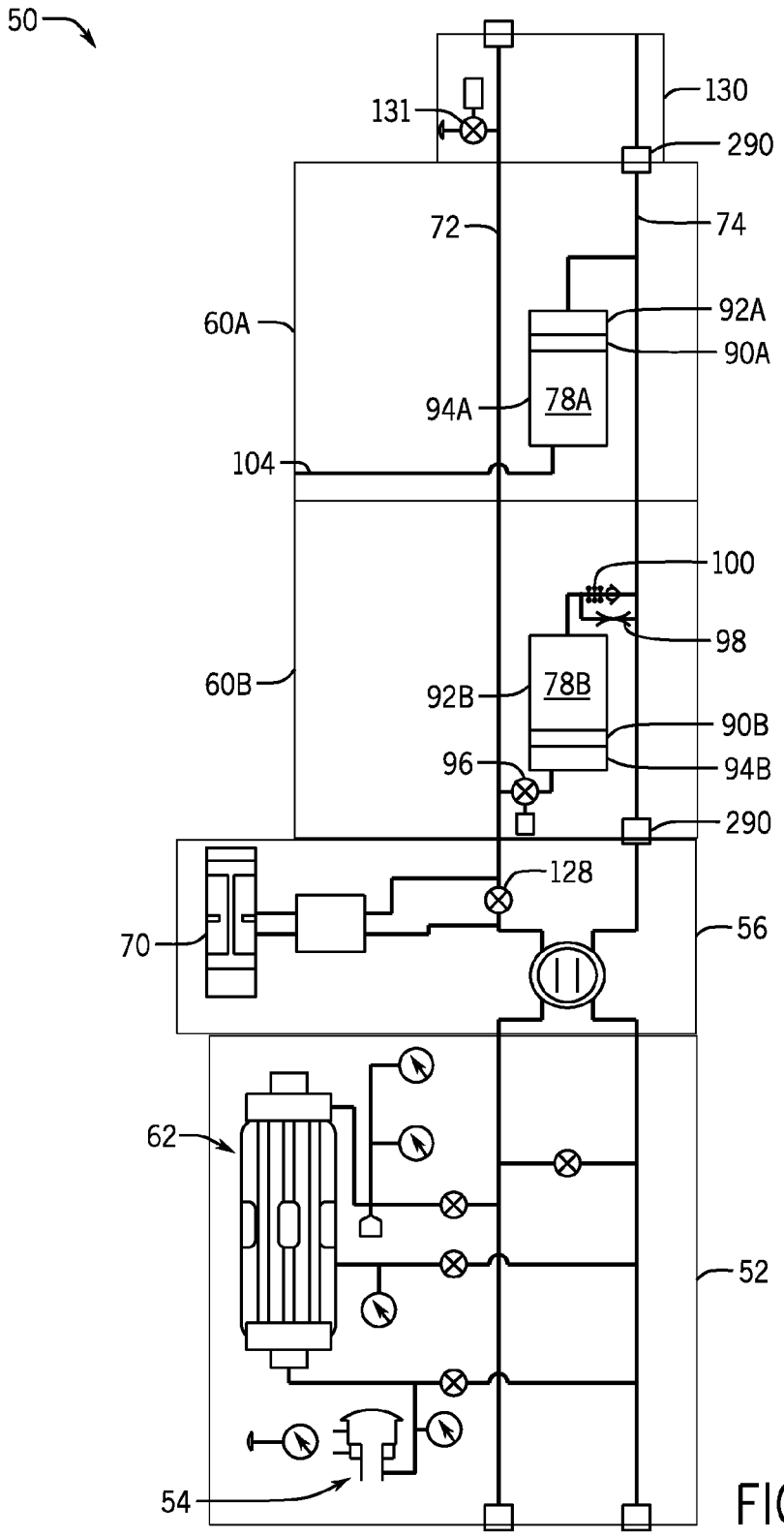
FIG. 14 is a schematic diagram of a downhole tool having bulk volume chambers for flowback control in accordance with an embodiment of the present techniques.

FIG. 14 illustrates an embodiment of the downhole tool 50 that is set up to perform this controlled flowback operation. The illustrated flowback loop of the downhole tool 50 includes two volume chamber module 60A and 60B, an exit-to-borehole module 130 disposed above the volume chamber modules 60A and 60B, a pump module 56 having the pump 70 coupled to the sample flowline 72, instead of the guard flowline 74, and a single probe module 52. It should be noted that other arrangements of these components may be used in other embodiments to provide the desired flowback control during micro-frac operations.

In the illustrated embodiment, the sample side 92A of the upper volume chamber 78A is open to the guard flowline 74, and the water side 94A of the upper volume chamber 78A is coupled via the open connection 104 to the borehole 26. The sample side 92B of the lower volume chamber 78B is connected to the guard flowline 74 through the parallel flow restrictor 98 and relief valve 100. As discussed above, the flow restrictor 98 may not be suitable for dirty fluids (e.g., fluids containing solids or fines), but the flow restrictor 98 does function well with clean fluids such as water, hydraulic oil, or glycol. The water side 94B of the lower volume chamber 78B is coupled to the sample flowline 72 via the seal valve 96. Above and below the volume chamber modules 60A and 60B, the guard flowline 74 is blocked via seals 290, creating a closed system between the sample sides 92 of the two volume chambers 78A and 78B.

During a flowback process, fluid flows from the formation 12 through the sample flowline 72 and into the water side 94B of the lower volume chamber 78B. This pushes the piston 90B up, forcing clean fluid out of the sample side 92B of the lower volume chamber 78B through the flow restrictor 98 and into the guard flowline 74. The flow restrictor 98 ensures a constant flow rate (or a constant pressure drop) of the clean fluid flowing therethrough. The fluid moves through the guard flowline 74 and into the sample side 92A of the upper volume chamber 78A. This moves the piston 90A downward, thereby forcing fluid from the water side 94A of the upper volume chamber 78A into the borehole 26.

When the sample side 92A of the upper volume chamber 78A is full of water, the downhole tool 50 may be reset for the next flowback process at another downhole station. Specifically, the downhole tool 50 may be configured to actuate the pump 70 to pull the formation fluid out of the water side 94B of the lower volume chamber 78B, direct the formation fluid through the sample flowline 72, and release the formation fluid to the borehole 26 via the probe module 52 when the probe 62 is in a retracted or deflated state. This lowers the piston 90B of the lower volume chamber 78B, thereby drawing the water from the upper volume chamber 78A back into the sample side 92B of the lower volume chamber 78B. The relief valve 100 on the sample side 92B of the lower volume chamber 78B may ensure that this resetting action is not slowed by the flow restrictor 98 at the sample side 92B of the lower volume chamber 78B.

Figure 15:
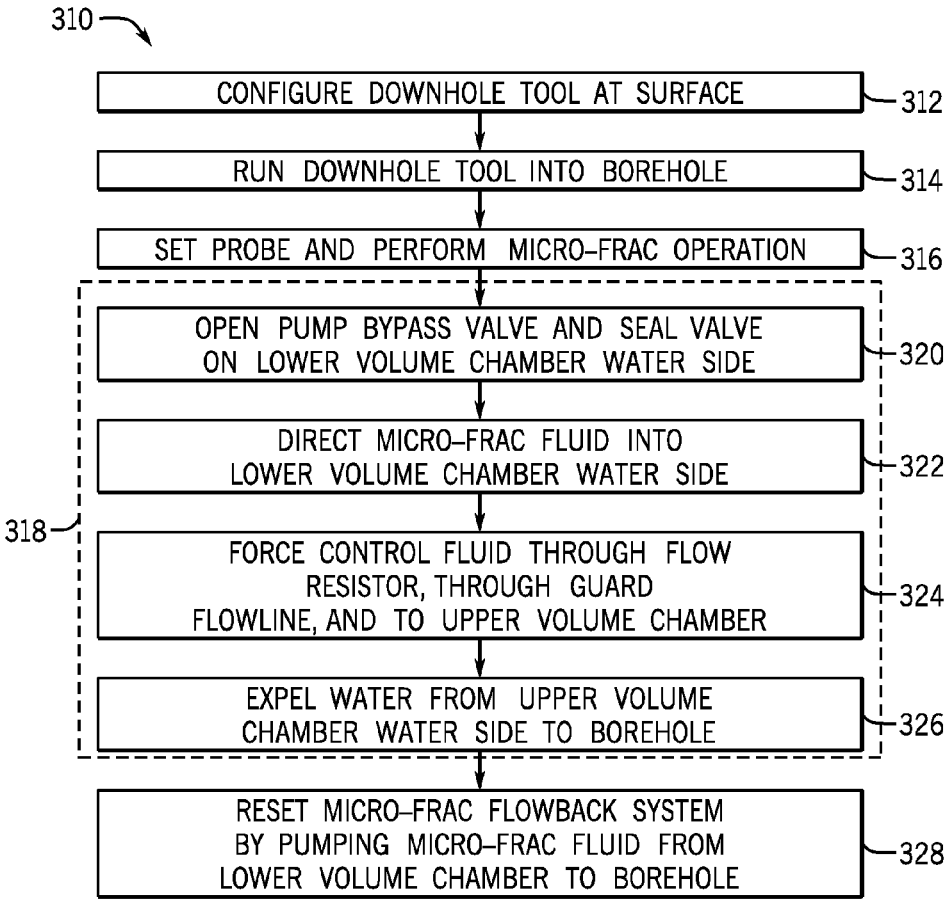
FIG. 15 is a process flow diagram of a method for operating the downhole tool of FIG. 14 to provide micro-frac flowback control, in accordance with an embodiment of the present techniques.

Having now generally described the structure and flowback functions available using the downhole tool 50 of FIG. 14, a more detailed description of a method 310 for providing this flowback control is given in FIG. 15. As discussed above, the two volume chambers 78 are coupled together with a closed water (or oil) circuit between them along the guard flowline 74. This may enable the flow restrictor 98 (or some other constant flow valve) to restrict the rate at which fluid that was pumped into the formation 12 to cause a micro-frac is able to flow back into the downhole tool 50. Using the arrangement of volume chambers 78 and the two flowlines 72 and 74, the downhole tool 50 is configured to utilize the pump 70 to control the flow of fluid from the formation 12 at a relatively high pressure into the downhole tool 50 at a relatively lower pressure.

To accomplish this controlled flowback process, the method 310 includes configuring (block 312) the downhole tool 50 at the surface as desired. For example, this configuration may include filling the sample side 92B of the lower volume chamber 78B with control fluid (e.g., water, glycol, hydraulic oil, or mineral oil). The control fluid should be clean enough to flow through the flow restrictor 98. The upper volume chamber 78A may be filled with water on the water side 94A, which is open to the borehole 26 via the open connection 104. The seals 290 may be set to block the guard flowline 74 at the top of the upper volume chamber 78A and below the lower volume chamber 78B. This creates the closed fluid circuit between the two sample sides 92A and 92B, allowing the flow restrictor 98 to control the flowback operation by restricting the flow of control fluid from the lower volume chamber 78B to the upper volume chamber 78A.

In addition, the method 310 includes running (block 314) the downhole tool 50 into the borehole 26, such as by lowering the downhole tool 50 via a wireline, drilling system, coiled tubing, or some other method. Upon reaching a desired depth, the method 310 includes setting the probe 62 (e.g., single packer or dual packer formation interface device) and performing (block 316) the micro-frac operation of injecting fluid into the formation 12 via the probe 62 to fracture the formation 12.

Upon completing the micro-frac operation, the method 310 includes controlling (block 318) the flow of formation fluid back into the downhole tool 50. This involves opening (block 320) the pump bypass valve 128 and the seal valve 96 on the water side 94B of the lower volume chamber 78B. As the micro-frac fluid flows into the downhole tool 50 via the probe 62, it is directed (block 322) through the sample flowline 72 to the water side 94B of the lower volume chamber 78B. From here, the micro-frac fluid at the higher pressure pushes the piston 90B upward, forcing (block 324) the control fluid out of the flow restrictor 98 through the guard flowline 74 and into the sample side 92A of the upper volume chamber 78A. This pushes the piston 90A of the upper volume chamber 78A downward, expelling (block 326) the water from the water side 94A of the upper volume chamber 78A to the borehole 26. At the completion of this flowback operation (block 318), other operations such as sampling, PVT analysis, and other analysis of the formation fluid may be performed by other components within the downhole tool 50. In addition, the downhole tool 50 may perform calculations based on a measured pressure of the formation fluid as it flowed back into the downhole tool 50.

The method 310 may also include resetting the micro-frac flowback system by pumping (block 328) the flowback formation fluid out of the lower volume chamber 78B to the borehole 26 via the exit port valve 131. This draws the control fluid from the sample side 92A of the upper volume chamber 78A back to the sample side 92B of the lower volume chamber 78B. The relief valve 100 may allow the fluid to flow back into the lower volume chamber 78B at a relatively faster flow rate than would be possible using the restrictor 98. This automatic reset feature allows the downhole tool 50 to perform the same operations of blocks 314 to 328 multiple times while the downhole tool 50 is disposed in the borehole 26. The reset may allow for the downhole tool 50 to continue the flowback operation after the lower volume chamber 78B has been completely filled.

Figure 16:
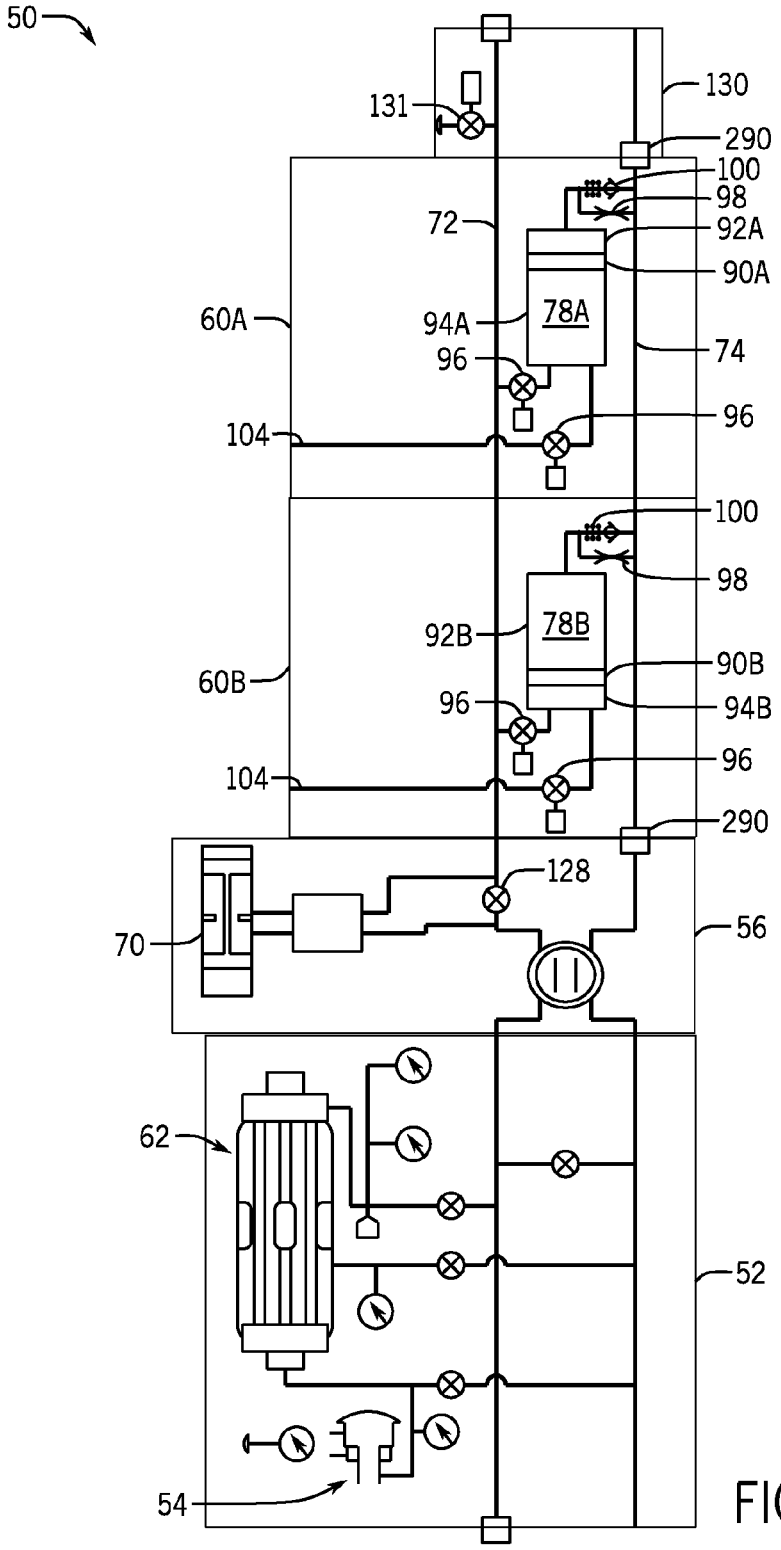
FIG. 16 is a schematic diagram of a downhole tool having bulk volume chambers for flowback control in micro-fracturing operations in accordance with an embodiment of the present techniques.

Another embodiment of the downhole tool 50 capable of performing the micro-frac flowback operation is illustrated in FIG. 16. This downhole tool 50 is configured to allow the flowback after a micro-frac operation in a similar fashion to the downhole tool 50 of FIG. 14 without having to reset the system when the lower volume chamber 78B is full. Instead, when the illustrated piston 90B in the lower volume chamber 78B reaches the end of the stroke (e.g., the top of the chamber), the downhole tool 50 may divert the flowback to the upper volume chamber 78A as the process continues.

In the illustrated embodiment, the downhole tool 50 includes a closed (clean) water or oil circuit disposed between the upper and lower volume chambers 78A and 78B, as described above with reference to FIG. 14. This may enable the flow restrictor 98 or a constant flow valve to restrict the rate at which the fluid that was pumped into the formation 12 to cause a micro-frac flows back into the downhole tool 50. The illustrated downhole tool 50 supports constant operation by alternately directing flowback fluid to the lower volume chamber 78B and to the upper volume chamber 78A without interruptions in the operation (e.g., for resetting the system). The above described downhole tool 50 of FIG. 14 instead supported flowback into the lower volume chamber 78B and then used pumping to remove the fluid from the lower volume chamber 78B before continuing the flowback process. It should be noted that both the downhole tools 50 illustrated in FIGS. 14 and 16 that perform the flowback control may be fitted with piston position sensing devices that allow the flow rate of the fluid to be measured.

Figure 17:
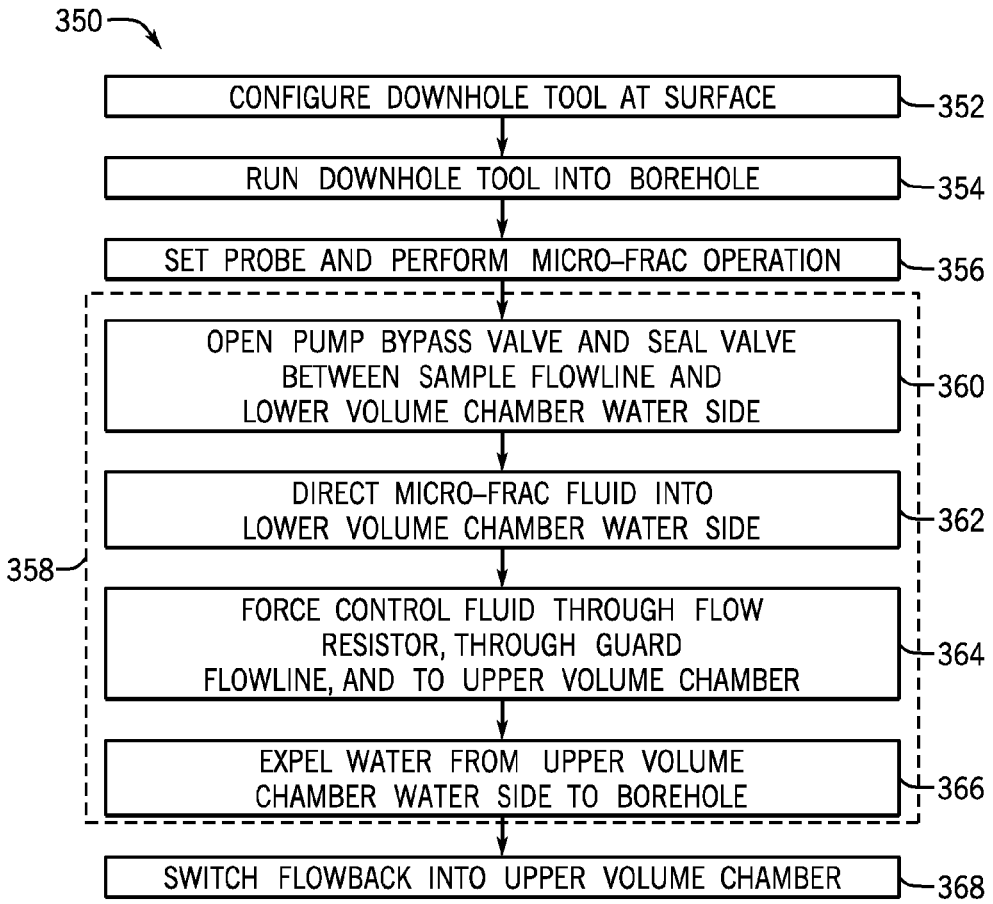
FIG. 17 is a process flow diagram of a method for operating the downhole tool of FIG. 16 to provide micro-frac flowback control, in accordance with an embodiment of the present techniques.

Having now generally described the structure and flowback functions available using the downhole tool 50 of FIG. 16, a more detailed description of a method 350 for providing this flowback control is given in FIG. 17. As discussed above, the two volume chambers 78 are coupled together with a closed water (or oil) circuit between them along the guard flowline 74. This may enable the flow restrictor 98 (or some other constant flow valve) to restrict the rate at which fluid that was pumped into the formation 12 to cause a micro-frac is able to flow back into the downhole tool 50. Using the arrangement of volume chambers 78 and the two flowlines 72 and 74, the downhole tool 50 is configured to utilize the pump 70 to control the flow of fluid from the formation 12 at a relatively high pressure into the downhole tool 50 at a relatively lower pressure.

To accomplish this controlled flowback process, the method 350 includes configuring (block 352) the downhole tool 50 at the surface as desired. For example, this configuration may include filling the sample side 92 of one of the volume chambers 78 (e.g., lower volume chamber 78B) with control fluid. The control fluid may include water, glycol, hydraulic oil, or mineral oil, and the control fluid should be clean enough to flow through the flow restrictor 98. The other one of the volume chambers 78 (e.g., upper volume chamber 78A) may be filled with water on the water side 94A at the surface. It should be noted that, in other embodiments, these volume chambers 78A and 78B may be filled in an opposite manner and will function generally the same way as described below. The seals 290 may be set to block the guard flowline 74 at the top of the upper volume chamber 78A and below the lower volume chamber 78B. This creates the closed fluid circuit between the two sample sides 92A and 92B, allowing the flow restrictor 98 to control the flowback operation by restricting the flow of control fluid from the lower volume chamber 78B to the upper volume chamber 78A.

In addition, the method 350 includes running (block 354) the downhole tool 50 into the borehole 26, such as by lowering the downhole tool 50 via a wireline, drilling system, coiled tubing, or some other method. Upon reaching a desired depth, the method 350 includes setting the probe 62 (e.g., single packer or dual packer formation interface device) and performing (block 356) the micro-frac operation of injecting fluid into the formation 12 via the probe 62 to fracture the formation 12.

Upon completing the micro-frac operation, the method 350 includes controlling (block 358) the flow of formation fluid back into the downhole tool 50. This involves opening (block 360) the pump bypass valve 128 and the seal valve 96 between the sample flowline 72 and the water side 94B of the lower volume chamber 78B. As the micro-frac fluid flows into the downhole tool 50 via the probe 62, it is directed (block 362) through the sample flowline 72 to the water side 94B of the lower volume chamber 78B. From here, the micro-frac fluid at the higher pressure pushes the piston 90B upward, forcing (block 364) the control fluid out of the flow restrictor 98 through the guard flowline 74 and into the sample side 92A of the upper volume chamber 78A. This pushes the piston 90A of the upper volume chamber 78A downward, expelling (block 366) the water from the water side 94A of the upper volume chamber 78A to the borehole 26 through open the seal valve 96.

At any time throughout this process, and generally when the lower volume chamber 78B becomes full of the formation flowback fluid, the method 350 includes switching (block 368) the flowback into the upper volume chamber 78A. To do so, the seal valve 96 between the lower volume chamber 78B and the sample flowline 72 is closed and the seal valve 96 between the lower volume chamber 78B and the borehole 26 is opened. In addition, the seal valve 96 between the upper volume chamber 78A and the sample flowline 72 is opened and the seal valve 96 between the upper volume chamber 78A and the borehole 26 is closed. By changing the state of the downhole tool 50 in this manner, the flowback fluid may be redirected into the water side 94A of the upper volume chamber 78A. Consequently, this pushes the control fluid out of the sample side 92A of the upper volume chamber 78A through the restrictor 98 and through the guard flowline 74 to the sample side 92B of the lower volume chamber 78B. This switch in valve positions may facilitate a nearly continuous flowback operation with minimal operations for pumping or resetting components of the downhole tool 50, thereby increasing the efficiency of the flowback control.

At the completion of the entire flowback (block 358) and switching (block 368) operations, other operations such as sampling, PVT analysis, and other analysis of the formation fluid may be performed by other components within the downhole tool 50. In addition, the downhole tool 50 may perform calculations based on a measured pressure of the formation fluid as it flowed back into the downhole tool 50.

It should be noted that the downhole tool 50 in any of the above described embodiments may be attached to and used in conjunction with conventional downhole tools (e.g., fluid analysis, sample chambers and bottles, PVT analysis equipment, etc.) that utilize a single flowline instead of two. These tools may be added to the top of the string of modules that make up the illustrated downhole tools 50, such as between the upper volume chamber 78A and the exit-to-borehole module 130 in the illustrated embodiment. The single flowline of these additional tools may be an extension of the sample flowline 72. This may preserve the full sampling and analysis functionalities traditionally available using such tools. It should also be noted that the downhole tool 50 in any of the above described embodiments may be attached to and used in conjunction with conventional downhole tools (e.g., fluid analysis, sample chambers and bottles, PVT analysis equipment, etc.) that utilize dual flowlines, if these tools are added to the bottom of the string of modules that make up the illustrated downhole tools 50.

The specific embodiments described above have been shown by way of example, and it should be understood that these embodiments may be susceptible to various modifications and alternative forms. It should be further understood that the claims are not intended to be limited to the particular forms disclosed, but rather to cover any modifications, equivalents, and alternatives falling within the spirit and scope of this disclosure.

What is claimed is:

1. A method, comprising:

engaging a subterranean formation via a probe of a downhole tool disposed in a borehole of the subterranean formation, wherein the downhole tool comprises a sample flowline, a guard flowline, and a first volume chamber, wherein the first volume chamber comprises a first side fluidly coupled to the sample flowline, a second side fluidly coupled to the guard flowline, and a piston separating the first side from the second side;

controlling a first fluid flow from the first volume chamber into and through the guard flowline, the first fluid flow entering the guard flowline at a first pressure;

controlling a second fluid flow through the sample flowline based on the first fluid flow through the guard flowline, wherein controlling the second fluid flow comprises moving the second fluid flow from an environment with a second pressure to an environment with a third pressure, wherein the second pressure is higher than the third pressure; and pumping, via a reciprocating pump in fluid communication with the guard flowline, the first fluid flow from the first volume chamber through the guard flowline and into a second volume chamber, wherein the second volume chamber comprises a first side fluidly coupled to the sample flowline, a second side fluidly coupled to the guard flowline, and a piston separating fluid in the first side from fluid in the second side; and pushing the second fluid flow from the first side of the second volume chamber at a controlled rate based on a rate of the first fluid flow entering the second side of the second volume chamber from the guard flowline.

2. The method of claim 1, wherein the second fluid flow comprises a formation fluid sampled from the subterranean formation into the downhole tool via the probe, and wherein pushing the second fluid flow from the first side of the second volume chamber at a controlled rate comprises re-injecting the formation fluid into the subterranean formation.

3. The method of claim 1, wherein the second fluid flow comprises a chemical configured to alter a property of the subterranean formation, wherein the chemical is loaded into the downhole tool prior to disposing the downhole tool in the borehole, and wherein pushing the second fluid flow from the first side of the second volume chamber at a controlled rate comprises injecting the chemical into the subterranean formation.

4. The method of claim 1, wherein the second fluid flow comprises a tracer that is identifiable via the downhole tool, wherein the tracer is loaded into the downhole tool prior to disposing the downhole tool in the borehole, wherein pushing the second fluid flow from the first side of the second volume chamber at a controlled rate comprises injecting the tracer into the subterranean formation.

5. The method of claim 4, comprising:

injecting the tracer into the subterranean formation via the probe of the downhole tool;

pumping formation fluid from the subterranean formation through a second probe and into the downhole tool via a second reciprocating pump; and detecting, via sensing components of the downhole tool, the tracer entering the downhole tool through the second probe; and controlling an operation of the downhole tool based on detection of the tracer.

6. The method of claim 1, comprising:

sampling a heavy oil or emulsion into the sample flowline via the probe;

circulating the heavy oil or emulsion between the sample flowline and the guard flowline via a reciprocating pump;

sensing, via pressure sensors, a pressure drop through a portion of the sample flowline, the guard flowline, or both; and calculating a viscosity of the heavy oil or emulsion based on the sensed pressure drop.

7. A method, comprising:

engaging a subterranean formation via a probe of a downhole tool disposed in a borehole of the subterranean formation, wherein the downhole tool comprises a sample flowline, a guard flowline, and a first volume chamber, wherein the first volume chamber comprises a first side fluidly coupled to the sample flowline, a second side fluidly coupled to the guard flowline, and a piston separating the first side from the second side;

controlling a first fluid flow from the first volume chamber into and through the guard flowline, the first fluid flow entering the guard flowline at a first pressure;

controlling a second fluid flow through the sample flowline based on the first fluid flow through the guard flowline, wherein controlling the second fluid flow comprises moving the second fluid flow from an environment with a second pressure to an environment with a third pressure, wherein the second pressure is higher than the third pressure; and controlling the first fluid flow from the first volume chamber into and through the guard flowline via a flow restrictor disposed between the second side and the guard flowline;

wherein controlling the second fluid flow through the sample flowline comprises receiving the second fluid flow into the first side of the first volume chamber at a controlled rate based on a rate of the first fluid flow exiting the second side of the first volume chamber.

8. The method of claim 7, wherein the second fluid flow comprises a flowback fluid resulting from a micro-frac operation performed on the subterranean formation via the downhole tool.

* * * * *